US012372081B2

(12) United States Patent
Kohli et al.

(10) Patent No.: US 12,372,081 B2
(45) Date of Patent: Jul. 29, 2025

(54) SYSTEM AND METHOD FOR CONTROLLING CUMULATIVE PUMPING RATE

(71) Applicant: Halliburton Energy Services, Inc., Houston, TX (US)

(72) Inventors: Madhur Kohli, Houston, TX (US); Timothy Holiman Hunter, Duncan, OK (US); Bruce Carl Lucas, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 390 days.

(21) Appl. No.: 18/113,771

(22) Filed: Feb. 24, 2023

(65) Prior Publication Data

US 2024/0287980 A1 Aug. 29, 2024

(51) Int. Cl.

| | |
|---|---|
| ***F04B 49/00*** | (2006.01) |
| ***E21B 43/26*** | (2006.01) |
| ***F04B 17/03*** | (2006.01) |
| ***F04B 51/00*** | (2006.01) |

(52) U.S. Cl.

CPC ..... *F04B 49/007* (2013.01); *E21B 43/2607* (2020.05); *F04B 17/03* (2013.01); *F04B 51/00* (2013.01)

(58) Field of Classification Search

CPC ..... F04B 49/06; F04B 49/103; F04B 49/02; F04B 49/007; F04B 17/03; F04B 51/00; F04B 23/04; F04B 23/06; E21B 43/2607

USPC ..... 417/1

See application file for complete search history.

(56) References Cited

U.S. PATENT DOCUMENTS

| | | | | |
|---|---|---|---|---|
| 11,506,032 | B1 * | 11/2022 | Fisher | E21B 43/2607 |
| 2015/0083400 | A1 * | 3/2015 | Stephenson | F04B 49/00 417/538 |
| 2016/0032703 | A1 * | 2/2016 | Broussard | E21B 43/2607 166/250.01 |
| 2020/0300050 | A1 * | 9/2020 | Oehring | E21B 21/08 |
| 2021/0040830 | A1 * | 2/2021 | Mu | F04B 23/04 |
| 2021/0372394 | A1 * | 12/2021 | Bagulayan | F04B 23/04 |
| 2022/0112796 | A1 * | 4/2022 | Jaaskelainen | E21B 43/26 |
| 2022/0403723 | A1 * | 12/2022 | Yeung | B01F 23/581 |
| 2023/0024323 | A1 * | 1/2023 | Fripp | E21B 43/2607 |

* cited by examiner

*Primary Examiner* — Mark A Laurenzi
*Assistant Examiner* — Benjamin Doyle
(74) *Attorney, Agent, or Firm* — Conley Rose, P.C.; Rodney B. Carroll

(57) ABSTRACT

A method for balancing a pump load of a plurality of pumping units during a pumping operation comprising determining a first balance pump load based on a set of weighted factors. The method determines a second balanced pump load after receiving an indication of reduced pumping performance from a first pumping unit. The method excludes the first pumping unit from the second balanced pump load while maintaining the flowrate of the first balanced pump load. The method determines a transition pump load to transition from the first pump load to the second pump load as the first pumping unit ramps down.

20 Claims, 13 Drawing Sheets

SYSTEM AND METHOD FOR CONTROLLING CUMULATIVE PUMPING RATE

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydraulic fracturing operations may include a number of high pressure pumps directing proppant laden fluid into a hydrocarbon bearing formation. The proppant laden fluid must be pumped at pressure into downhole earth formations to produce fractures within the formation and provide a flow path to produce the desired hydrocarbons such as oil and gas. The pressures, flowrates, and concentration of the proppant laden fluids must be controlled to achieve the intended effect, and typically multiple pumps are used for purposes of volume and redundancy. When one pump fails, operators can compensate by manually adjusting the remaining pumps to maintain the desired concentration and flowrate of proppant into the downhole formation. An increase in pumping properties to one or more of the remaining pumps may be detrimental based on the health of the remaining pumps. A method of balancing the pumping properties among multiple pumps is desirable.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
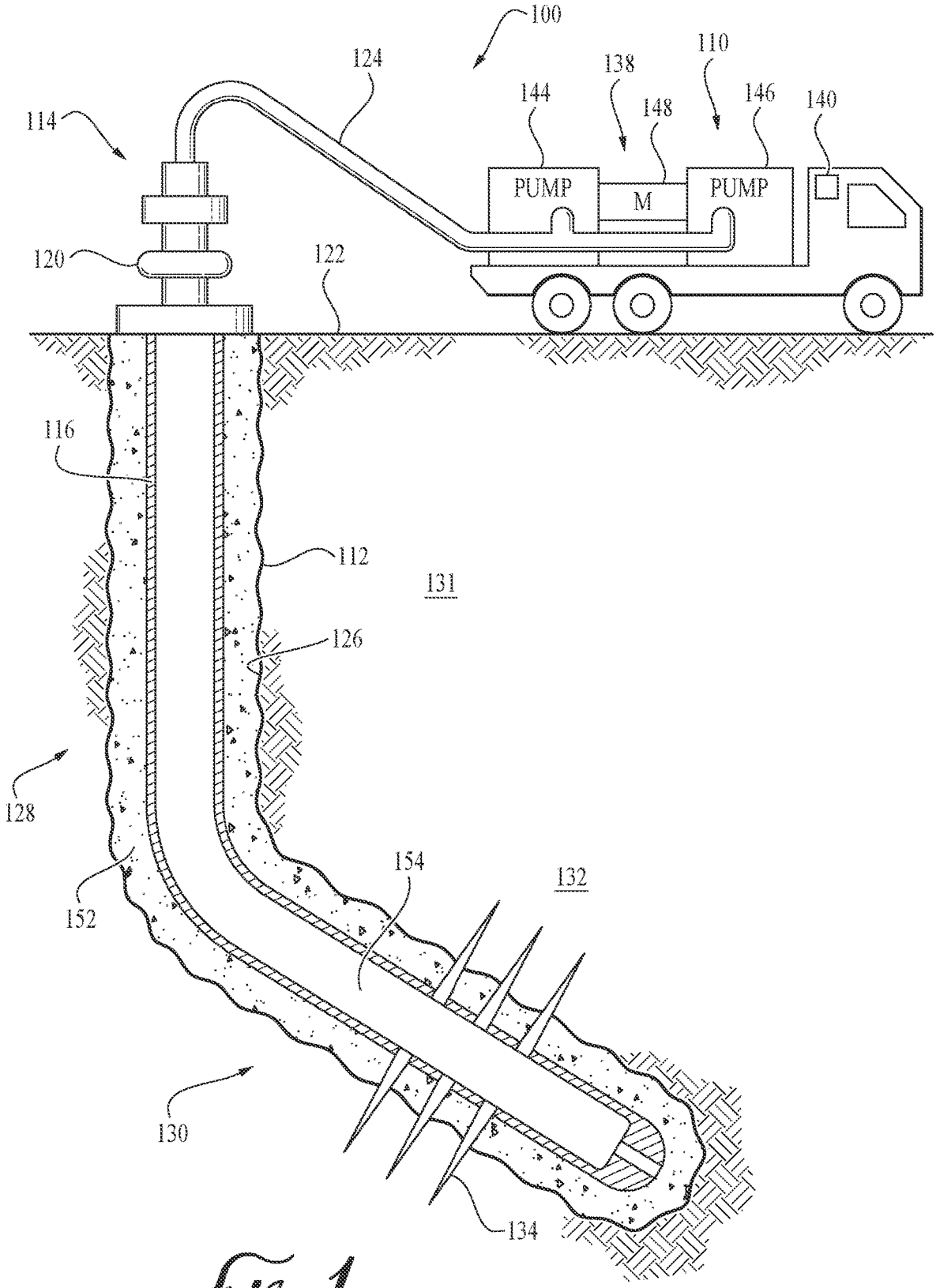
FIG. 1 is a partial cross-sectional view of a pumping operation environment at a wellsite according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, a pumping unit can comprise two pumps coupled to a prime mover. The term pump can refer to a fluid end, a positive displacement pump, a plunger pump, a piston pump, a progressive cavity pump, a gear pump, a screw pump, a lobe pump, a double screw pump, an impeller and diffuser, a centrifugal pump, a multistage centrifugal pump, a turbine, or any other type of pump suitable for pressurizing fluids. In some embodiments, the prime mover can include an electric motor, an internal combustion engine, or a hybrid motor configured to alternate between the two types of motor.

As used herein, a wellbore treatment can be any fluid pumped into a wellbore during the multiple stages of oil well construction. Each stage can be carried out with specialized equipment and wellbore treatments. Examples of various wellbore treatments can include drilling mud that is pumped down the wellbore by mud pumps. Drilling mud as a wellbore treatment can bring cutting back to surface and stabilize the inner surface of the wellbore. In another example, the various wellbore treatments can include cementitious slurry and any variety of spacer fluids that are pumped down the wellbore by cement pumps. Cement slurry as a wellbore treatment can be used to stabilize the wellbore, isolate subterranean formations, and form a barrier between formation fluids and a string of casing. In another scenario, the various wellbore treatments can include a fracturing slurry that is pumped down the wellbore by fracturing pumps. Fracturing slurry as a wellbore treatment can be used to fracture the wellbore, create seams, and fill the fractures with a propping material, e.g., sand, to provide a pathway for the production of wellbore fluids. The various wellbore treatments can include a wide variety of fluids including fracturing slurry, acidizing fluid, cementing fluid, spacer fluids, resin compounds for formation consolidation or isolation, weighted fluids for well control and/or intervention, gravel packing fluids for sand placement, solvent for cleaning, water and/or completion fluids for tool placement, clean-out, circulating, jetting and other remediation treatments.

As used herein, a "clean" pump may refer to a pump that is used for pumping fluid that substantially comprises water. Similarly, "clean" fluid may refer to fluid that contains a minimal amount or no proppant or sand. In certain instances, "clean" fluid may comprise additives such as salts, friction reducers, corrosion inhibitor, gelling agents, acidifying agents, chemical additives, or any other types of additives. "Dirty" fluid may refer to fluid that comprises sand or proppant, or fluid that is sand-laden. A "dirty" pump may refer to a pump that is used for pumping fluid that comprises sand or proppant. In certain instances, the dirty pumping units may pump fluids with a proppant concentration of 5% to 60%. As used herein, "dirty" fluid may also be referred to as "slurry". In certain instances, "dirty" fluid may also comprise one or more additives, for example, the additives listed above with respect to the "clean" fluid. In certain instances, "low pressure" can refer to pressures less than 1,000 psi and "high pressure" can refer to pressures between 1,000 and 30,000 psi.

Certain embodiments of the present disclosure are directed to systems and methods for balancing the pumping load across multiple pumping units simultaneously fracturing one or more wellbores. In certain instances, it may be desirable to have independent control of the one or more pumping units, for example, both clean pumping units and dirty pumping units, to maintain a constant rate of proppant-laden fluid delivered to the wellbore. Adjusting the pumping load of individual pumping units downstream of the blender based on a number of weighted factors, also referred to as operational factors, may provide more reliability and fewer maintenance events while maintaining the amount and pressure of fracturing fluid pumped into a given well bore. Balancing the pumping load on a plurality of pumping units may allow for the reduction in pumping load and eventual replacement of a pump with decreasing pumping performance.

A balancing process can remove a pump, e.g., fluid end, from a pumping operation while compensating for the loss of pumping flowrate with the pumps, e.g., fluid ends, of the remaining pumping units. In some embodiments, the balancing process can stop the pumping operation of a selected pumping unit, decouple a pump, e.g., fluid end, with decreased pumping performance from the prime mover and return the selected pumping unit to the pumping operation utilizing the other pump coupled to the prime mover. In some embodiments, the balancing process can remove and replace a selected pumping unit with a pumping unit held in reserve.

Turning now to FIG. 1, a partial cross-sectional view of a wellbore servicing environment 100 is described. In some embodiments, a pumping unit 110 may be fluidically coupled to a wellbore 112 at a remote wellsite 114. The remote wellsite 114 may be on land and the wellbore treatment and the pumping unit 110 can be optimized for the wellsite on land. In some embodiments, the remote wellsite 114 may be offshore and the wellbore treatment and pumping unit 110 can be optimized for a wellsite offshore. For example, the pumping unit 110 utilized offshore may be skid mounted whereas the pumping unit 110 utilized on land may be truck mounted or trailer mounted.

The wellbore 112 can be drilled with any suitable drilling system. A casing string 116 can be conveyed into the wellbore 112 by a drilling rig, a workover rig, an offshore rig, or similar structure (not shown). A wellhead 120 may be coupled to the casing string 116 at surface 122. The pumping unit 110, located offshore or on land, can be fluidically coupled to a wellhead 120 by a high pressure line 124. The wellbore 112 can extend in a substantially vertical direction away from the earth's surface 122 and can be generally cylindrical in shape with an inner bore 126. At some point in the wellbore path, the vertical portion 128 of the wellbore 112 can transition into a substantially horizontal portion 130. The wellbore 112 can be drilled through the subterranean formation 131 to a hydrocarbon bearing formation 132. Perforations 133 made during the completion process that penetrate the casing string 116 and hydrocarbon bearing formation 132 can enable the fluid in the hydrocarbon bearing formation 132 to enter the casing string 116.

In some embodiments, the pumping unit 110, also called a fracturing unit, comprises a pumping system 138 and a unit controller 140. The pumping system 138 comprises a first pump 144, a second pump 146, and a prime mover 148. The prime mover 148 can be an electrical motor rotationally coupled to the first pump 144 and the second pump 146. The pumping system 138 can receive a fracturing fluid from a fluid source, e.g., a blender, and can deliver the fracturing fluid to the wellbore 112 via the high pressure line 124. The unit controller 140 may be a computer system suitable for communication with the service personnel, communication with a central controller, and control of the pumping system 138 as will be described further herein.

In some embodiments, the wellbore 112 can be completed with a cementing process that places a cement slurry between the casing string 116 and the wellbore 112 to cure into a cement barrier 152. The wellhead 120 can be any type of pressure containment equipment connected to the top of the casing string 116, such as a surface tree, production tree, subsea tree, lubricator connector, blowout preventer, or combination thereof. The wellhead 120 can include one or more valves to direct the fluid flow from the wellbore 112 and one or more sensors that measure wellbore properties such as pressure, temperature, and/or flowrate data.

The pumping unit 110 can follow a pump procedure with multiple sequential steps to deliver a wellbore treatment, e.g., proppant slurry, into the wellbore 112. The pumping unit 110 can be fluidically coupled to a wellbore treatment fluid source, e.g., a blender (not shown). The pumping unit 110 can deliver a wellbore treatment fluid to the hydrocarbon bearing formation 132 via the perforations 134. The pumping unit 110 can place the wellbore treatment fluid with sufficient volume and pressure to split or "fracture" the formation 132 along veins or planes extending from the wellbore 112. In some embodiments, the fracturing fluid comprises propping agents, also referred to as proppant, that are deposited into the fractures, e.g., veins, to support and/or prevent the fractures from closing. These proppants, e.g., sand and/or ceramic beads, can create a highly permeable fluid pathway to the inner bore of the casing string 116 via the perforations 134.

In some embodiments, the wellbore servicing environment 100 can comprise additional completion equipment to direct the wellbore treatment fluids into a target location. For example, a fracturing plug, e.g., wellbore isolation plug, can be set or installed below a target location for a set of perforations, e.g., perforations 134, to isolate the wellbore 112 below the target location from pumping pressures. In some embodiments, one or more perforating guns can be utilized to produce additional perforations, in coordination with, the one or more fracturing plugs. In another scenario, a fracturing valve, e.g., production sleeve, can be coupled to the casing string 116 and installed at a target depth. The fracturing valve can be opened for the placement of a wellbore treatment and can closed afterward. Although one set or location for the perforations 134 is illustrated in the wellbore servicing environment 100, it is understood that the wellbore servicing environment can comprise 1, 2, 3, 4, 5, 6, 7, 8, 9, 10, or any number of sets of perforations 134.

Figure 2:
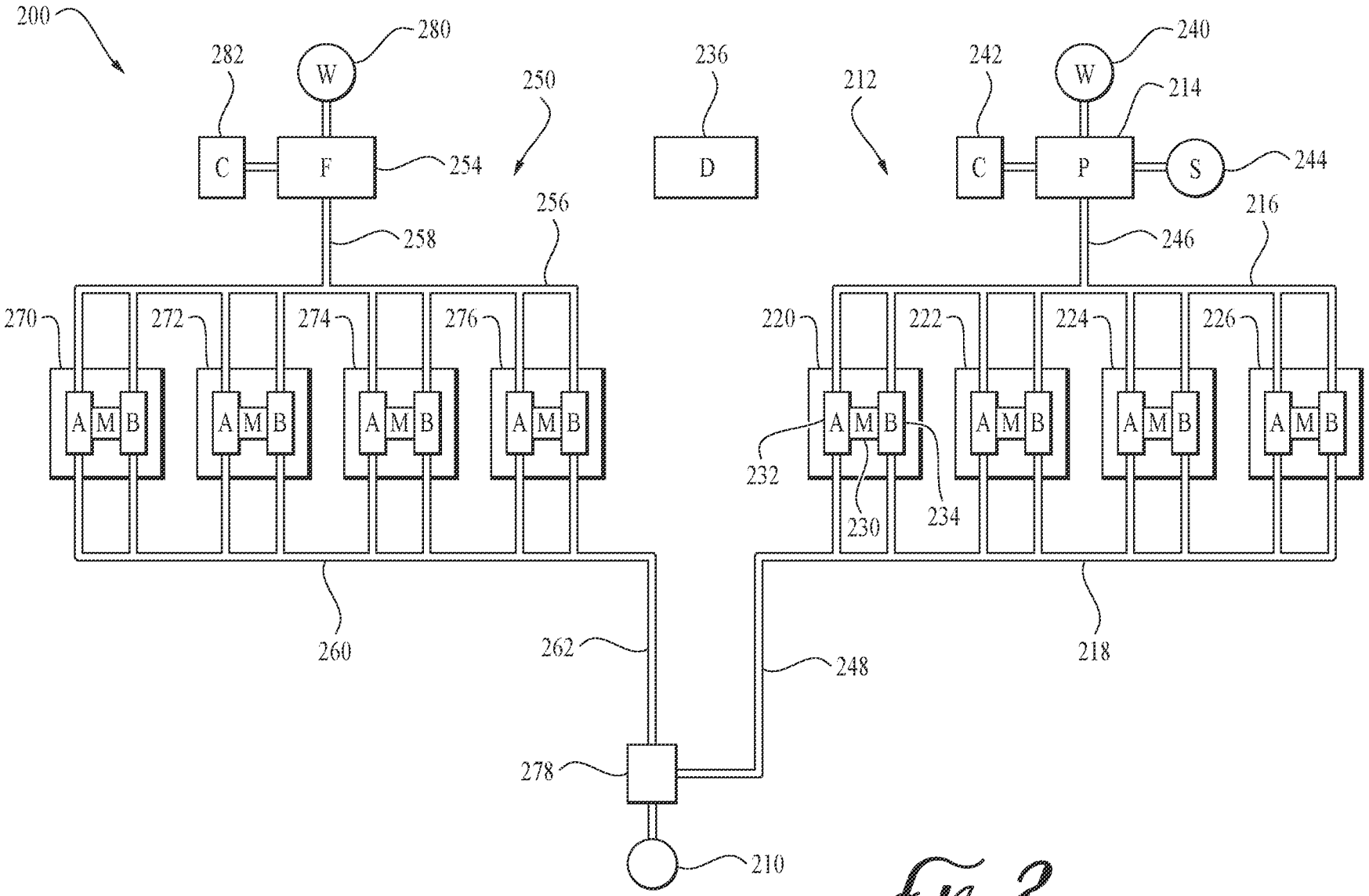
FIG. 2 is a schematic view of a fracturing spread for placement of a wellbore treatment into a wellbore according to an embodiment of the disclosure.

The pumping unit 110 can be part of a fracturing fleet, also referred to as a fracturing spread, comprising a plurality of pumping units fluidically coupled to a wellbore via a high pressure manifold and working in concert to place a proppant slurry into a subterranean formation. Turning now to FIG. 2, an exemplary fracturing spread 200 is described. As illustrated in FIG. 2, the exemplary fracturing spread 200 can comprise one or more groups of pumping units fluidically coupled to a wellbore 210. A first group of pumping units 212 can be coupled to a blender unit 214 providing a proppant slurry and can be referred to as dirty pumping units 212. The dirty pumping units 212 can be fluidically coupled to the dirty blender 214 by a low pressure manifold 216 and the wellbore 210 by a high pressure manifold 218 and a high pressure line 248. The first group of pumping units 212 can include pumping units 220, 222, 224, and 226. Each of the pumping units, e.g., pumping unit 220, can be an embodiment of pumping unit 110 from FIG. 1 and comprise a prime mover 230, e.g., prime mover 148, rotationally coupled to a first pump 232, e.g., first pump 144, and a second pump 234, e.g., second pump 146. The prime mover 230 can be an electric motor. For reference, the pumps 232, 234 are labeled A, B and the prime mover 230 is labeled M. Hereinafter, the term pump 220A will refer to the first pump 232 powered by the prime mover 230 of the pumping unit 220. The term pump 220B will refer to the second pump 234 of the pumping unit 220. The term motor 220M will refer to the prime mover 230 of the pumping unit 220. Likewise, the pumps and prime movers of the other pumping units are labeled with A, B, and M. For example, the term pump 222A, pump 224A, and pump 226A will refer to the first pump of each corresponding pumping units 222, 224, and 226 respectively.

The fracturing units of the fracturing spread 200 can be communicatively coupled to a control center 236. The control center 236 comprises one or more controllers, e.g., computer systems, configured to direct the pumping operation of each of the fracturing units of the fracturing spread 200 while receiving periodic datasets indicative of the pumping operation. For example, the control center 236 can direct the dirty pumping units 212 to pump the proppant slurry into the wellbore 210 at a desired flowrate and pressure with the dirty blender 214 to suppling the desired concentration of proppant slurry to the dirty pumping units 212 via the low pressure manifold 216. The controller within the control center can be communicatively connected to a unit controller, e.g., unit controller 140 of FIG. 1, of each of the fracturing units. The controller can be communicatively connected to the unit controller of each of the fracturing units by wired communication, wireless communication, or combinations thereof.

The blender unit 214 can mix liquid, e.g., water, with various chemicals and a proppant, e.g., sand, to produce the proppant slurry. In some embodiments, the blender unit 214, also referred to as the dirty blender, can produce a gelled water by mixing water from a water supply unit 240 and various chemicals from a chemical unit 242. The proppant slurry can be produced by mixing proppant from a proppant supply unit 244 to produce a desired concentration of proppant within the proppant slurry. The dirty blender 214 can be fluidically coupled to the low pressure manifold 216 by a supply line 246.

The fracturing units of the fracturing spread 200 can include a plurality of sensors to provide periodic datasets to the unit controller within each fracturing unit and to the controller within the control center 236. For example, each pumping unit, e.g., pumping unit 220 can have a flowrate sensor coupled to the pump 220A inlet, a pressure sensor coupled to the pump 220A outlet, and a position sensor coupled to the motor 220M. The plurality of sensors can provide periodic datasets of the pumping operation and of a status of each of the pumping units, e.g., pumping unit 220, to the controller within the control center 236. The sensors can be communicatively connected to the unit controller and/or the controller within the control center 236 by wired communication, wireless communication, or combinations thereof.

In some embodiments, one or more sensors can be fluidically coupled with the wellbore 210, for example, a sensor can be coupled to a wellhead, a production tree, a fracturing tree, a wellhead isolation device, or combinations thereof. The sensors can be configured to measure one or more wellbore environment properties such as wellbore pressure and wellbore temperature. The sensors can be configured to measure wellbore treatment fluid properties, such as, density, flowrate, pressure, and temperature. In some embodiments, the one or more sensors can be located within the wellbore 210, for example, proximate to the formation, e.g., formation 132 of FIG. 1. In some embodiments, one or more sensors can be located in or coupled to adjacent wellbores, for example, in offset wells and/or observation wells. The one or more sensors coupled to the wellhead, located within the wellbore 210, or installed within adjacent wellbores can be communicatively coupled, by wired or wireless communication, to the one or more controllers within the control center 236.

In some embodiments, the first pumping unit group 212 can be an example of a typical fracturing spread with a dirty blender 214 supplying a proppant slurry with a desired proppant concentration to a plurality of pumping units, e.g., dirty pumping units 212, configured to pump the proppant slurry at a desired pressure and flowrate to a wellbore 210. In some embodiments, the first pumping unit group 212 can be coupled to two or more wellbores, e.g., wellbore 210, to perform a sequential or simultaneous fracture of the two or more wellbores.

The exemplary fracturing spread 200 can comprise a second pumping unit group 250 configured to pump a clean fluid to the wellbore 210. The second group of pumping units, also referred to as clean pumping units 250, can be coupled to a blender unit 254 providing a clean fluid by a low pressure manifold 256 via a supply line 258. A water supply unit 280 and a chemical unit 282 can be fluidically coupled to the blender unit 254, also referred to as a clean blender. The clean pumping units 250 can be fluidically coupled to the wellbore 210 by a high pressure manifold 260 and a high pressure line 262. The second pumping unit group 250, e.g., the clean pumps, can include pumping units 270, 272, 274, and 276. Each of the pumping units, e.g., pumping unit 270, can be an embodiment of pumping unit 110 from FIG. 1 and comprise a prime mover "M", e.g., prime mover 148, rotationally coupled to a first pump "A", e.g., first pump 144, and a second pump "B", e.g., second pump 146. As previously described, the pumps of each pumping unit are labeled A, B and the prime mover is labeled M. For example, the term pump 270A will refer to the first pump "A" powered by the prime mover "M" of the pumping unit 270.

The fracturing spread 200 can combine the clean fluid from the clean pumping units 250 with the dirty fluid, e.g., proppant slurry, from the dirty pumping units 212 at the wellbore 210. In some embodiments, the high pressure line 262 from the high pressure manifold 260 of the clean pumping units 250 and the high pressure line 248 from the high pressure manifold 218 of the dirty pumping units 212 can be coupled a fluid junction 278. The fluid junction 278 can be a fluid control component or could be a part of a fracturing manifold or wellhead coupled to the wellbore 210. In some embodiments a pressure and flowrate sensor can be located between the high pressure manifold 260 of the clean pumping units 250 and the fluid junction 278, for example, along the high pressure line 262. In some embodiments a pressure and flowrate sensor can be located between the high pressure manifold 218 of the clean pumping units 212 and the fluid junction 278, for example, along the high pressure line 248. The controller within the control center 236 can establish a flowrate of proppant slurry with a desired proppant concentration at the fluid junction 278 and/or the wellbore 210 by controlling the supply of clean fluid from the clean pumping units 250 and the supply of proppant slurry from the dirty pumping units 212. The fracturing spread 200 can maximize the concentration of proppant within the proppant slurry by shutting down the clean pumping units 250 and supplying proppant from the proppant supply unit 244 at an operational limit or operational maximum value. The fracturing spread 200 can minimize the concentration of proppant by pumping the clean fluid from the clean pumping units 250 and shutting down the dirty pumping units 212. Alternatively, the fracturing spread 200 can pump clean fluid from the clean pumping units 250 and clean fluid from the dirty pumping units 212 by shutting off the proppant supply unit 244 feeding the dirty blender 214.

In some embodiments, the fracturing spread 200 can simultaneously fracture two wellbores. Each pumping unit group, clean pumping units 250 and dirty pumping units 212, can be divided or split into two or more groups. For example, pumping unit 270, 272 of the clean pumping units 250 and pumping units 220, 222 of the dirty pumping units 212 can be coupled to a first wellbore and pumping unit 274, 276 of the clean pumping units 250 and pumping units 224, 226 of the dirty pumping units 212 can be coupled to a second wellbore. Although the fracturing spread 200 is described as fracturing two wellbores, it is understood that the fracturing spread 200 could fracture 2, 3, 4, 5, 6, or any number of wellbores simultaneously by adding more fracturing units.

Figure 3B:
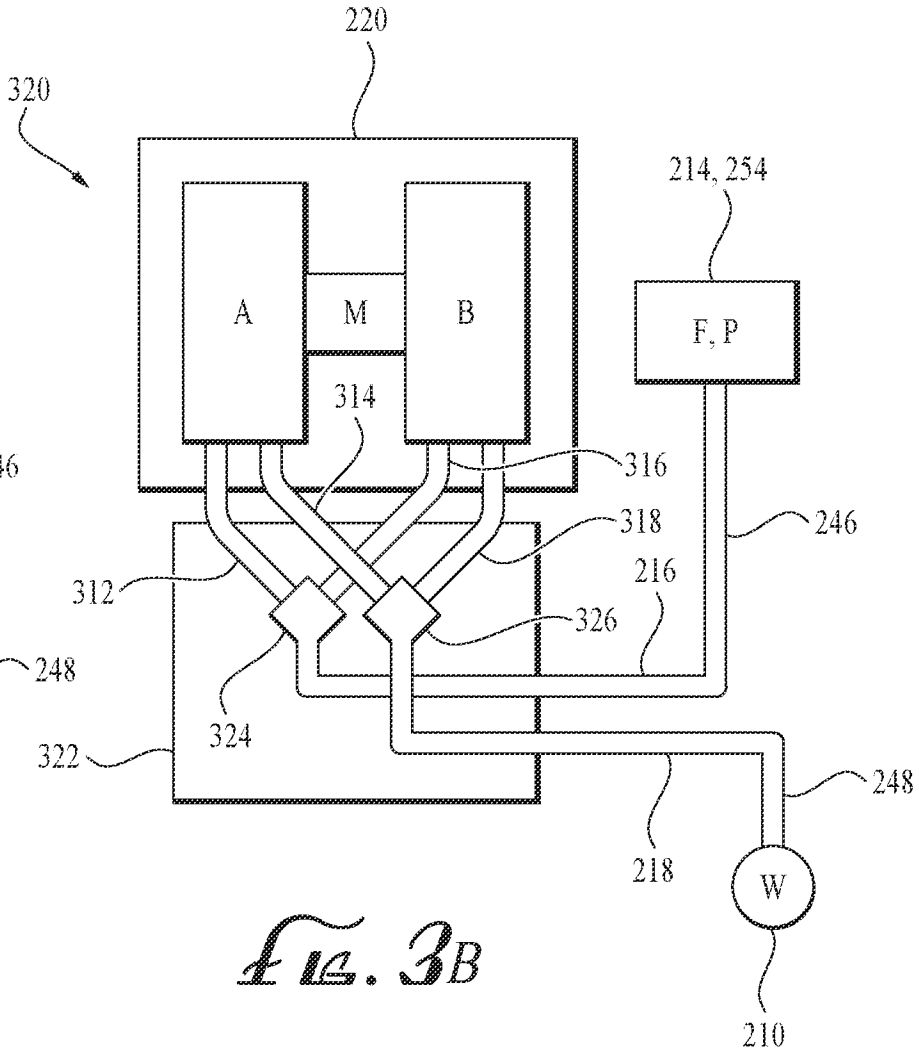
FIG. 3A-3E are a schematic views of an exemplary fluid network according to an embodiment of the disclosure.
Figure 3A:
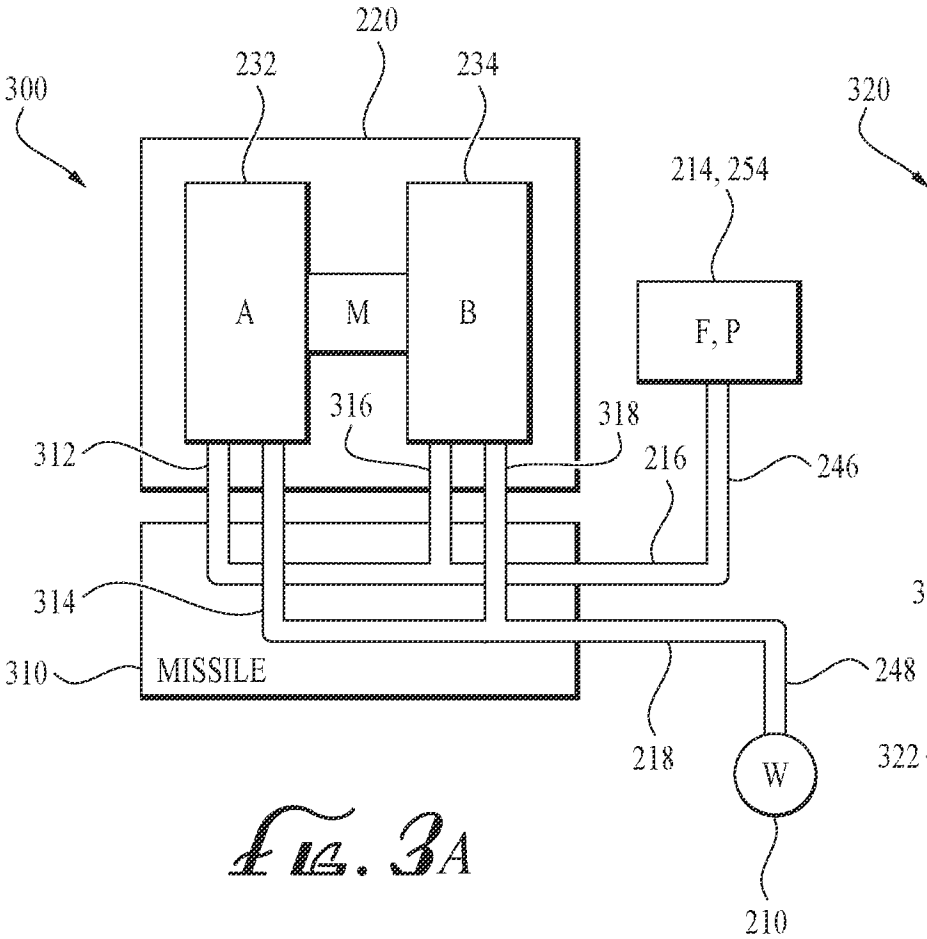

Turning now to FIG. 3A, an exemplary fluid network 300 for a pumping unit is described. In some embodiments, a fluid network 300 can comprise a pumping unit, a fluid manifold 310, a supply line 246, and a high pressure line 248. Although the exemplary fluid network 300 is described with pumping unit 220 from the first pumping unit group 212 of FIG. 2, it is understood that pumping unit 220 is an example and thus, any pumping unit similarly coupled to a blender and a wellbore could be utilized. The fluid manifold 310, commonly referred to as a missile, comprises the low pressure manifold 216 and the high pressure manifold 218 and may be movably mounted on a skid or trailer. A first inlet arm 312 can fluidically couple the pump A, e.g., first pump 232, to the low pressure manifold 216. The second inlet arm 316 can couple pump B, e.g., second pump 234, to the low pressure manifold 216. The first discharge arm 314 can fluidically couple the pump A to the high pressure manifold 218 and the second discharge arm 318 can couple the pump B to the high pressure manifold 218. The first inlet arm 312, the second inlet arm 316, the first discharge arm 314 and the second discharge arm 318 can include a swivel, an isolation valve, a fluid choke, a manual disconnect, an automatic disconnect, or combinations thereof. A supply line 246 can fluidically couple the low pressure manifold 216 to the dirty blender 214 or the clean blender 254. A high pressure line 248 can fluidically couple the high pressure manifold 218 to the wellbore 210. Although one pumping unit, e.g., pumping unit 220, is illustrated coupled to the fluid manifold 310, it is understood that there may be 1, 2, 3, 4, 5, 6, 7, 8, 9, 10, or any number of pumping units coupled to the fluid manifold 310 via corresponding inlet arms and discharge arms.

During pumping operations, exemplary fluid network 300 can feed the pumping unit 220 either a clean fluid or a dirty fluid from the blender unit 214, 254 and deliver high pressure fluid from the pumping unit 220 to the wellbore 210. The pumping unit 220 can receive clean fluid from the clean blender 254 via the low pressure manifold 216. The pumping unit 220 can receive either clean fluid or dirty fluid when the low pressure manifold 216 is coupled to the dirty blender 214. The fluid network 300 can deliver high pressure fluid from the pumping unit 220 to the wellbore 210 via the high pressure manifold 218. The pumping unit 220 can be configured in a dual pump mode or a single pump mode. In the dual pump mode, both of the pumps can be coupled to the motor and actively pumping. In the single pump mode, one of the two pumps can be coupled and the other pump can be decoupled so that only one pump is actively pumping. The unit controller, e.g., unit controller 140, can be calibrated to measure, calculate, and communicate the pumping operation of both pumps operating in the dual pump mode or the pumping operation of a single pump in the single pump mode. For example, the unit controller can report the flowrate of the pumping unit in dual mode is double the flowrate of the pumping unit in single mode. Similarly, the unit controller can calculate an increase or decrease rate of flowrate change in dual mode that is double the rate of flowrate change in single mode. If one of the pumps of the pumping unit 220 needs to be shut down due to decrease in pumping performance, the controller within control center 236 can direct the pumping unit 220 to ramp down and stop the pumping operation. The effected pump, for example pump 220B, can be isolated from the fluid manifold 310 and disconnected from the motor 220M. For example, an isolation valve on the inlet arm 316 can be closed to isolate the pump 220B from the low pressure manifold 216. An isolation valve on the discharge arm 318 can be closed to isolate the pump 220B from the high pressure manifold 218. The controller with in the control center 236 can recalibrate the unit controller of pumping unit 220 in single mode and restart the pumping unit 220 with the motor 220M powering the pump 220A while the pump 220B remains idle. The unit controller can direct the pumping operation of pumping unit 220 per the single mode calibration.

The calibration of the unit controller for either single mode or dual mode comprises a variety of parameters including pump count, power limit, torque limit, speed limit, temperatures, pressures, pressure/torque ratio, discharge rate per revolution, auxiliary system settings, prime mover drive settings/limits. For example, the flowrate of the pumping unit 220 in single mode is half the flowrate of the pumping unit 220 in single mode. In another example, the ramp rate (e.g., rate of change of flowrate) in single mode is twice as fast as the ramp rate in dual mode. In still another example, the torque limit in single mode is half the torque limit in dual mode. The unit controller can be calibrated or recalibrated based on the status of the pump, e.g., pump 220A. For example, the unit controller can determine if the pump 220A and pump 220B is connected to the motor 220M and calibrate the unit controller accordingly.

Turning now to FIG. 3B, a fluid network 320 for a pumping unit is described. In some embodiments, the fluid network 320 can comprise a pumping unit, a fluid manifold 322, a supply line 246, and a high pressure line 248. The fluid network 320 can share similar parts to previous embodiments that may likewise share the same reference numbers. The fluid manifold 322, e.g., the missile, comprises the low pressure manifold 216 with a wye-block 324 and the high pressure manifold 218 with a wye-block 326. A first inlet arm 312 and second inlet arm 316 can be coupled to the wye-block 324 and thus, to the low pressure manifold 216. The first discharge arm 314 and second discharge arm 318 can be fluidically coupled to the wye-block 326 and thus, to the high pressure manifold 218. A supply line 246 can fluidically couple the low pressure manifold 216 to the dirty blender 214 or the clean blender 254. A high pressure line 248 can fluidically couple the high pressure manifold 218 to the wellbore 210. Although one pumping unit, e.g., pumping unit 220, is illustrated coupled to the manifold 322, it is understood that there may be 1, 2, 3, 4, 5, 6, 7, 8, 9, 10, or any number of pumping units coupled to the manifold 322 via corresponding inlet arms and discharge arms.

During pumping operations, exemplary fluid network 320 can feed the pumping unit 220 either a clean fluid or a dirty fluid from the blender unit 214, 254 and deliver high pressure fluid from the pumping unit 220 to the wellbore 210. The pumping unit 220 can receive clean fluid from the clean blender 254 or can receive either clean fluid or dirty fluid when the low pressure manifold 216 is coupled to the dirty blender 214. The fluid network 320 can deliver high pressure fluid from the pumping unit 220 to the wellbore 210 via the high pressure manifold 218. As previously described, the unit controller can be calibrated for dual mode and the pumping unit 220 can be operating in dual mode, e.g., both pump A and pump B operating. If one of the pumps of the pumping unit 220 needs to be shut down due to decrease in pumping performance, the controller within control center 236 can direct the pumping unit 220 to ramp down and stop the pumping operation. The effected pump, for example pump 220B, can be isolated from the fluid manifold 322 and disconnected from the motor 220M. For example, an isolation valve on the inlet arm 316 and the discharge arm 318 can be closed to isolate the pump 220B from the low pressure manifold 216 and high pressure manifold 218 respectively. The controller with in the control center 236 can recalibrate the unit controller of pumping unit 220 in single mode and can restart the pumping unit 220 with the motor 220M powering the pump 220A while the pump 220B remains idle.

Figure 3C:
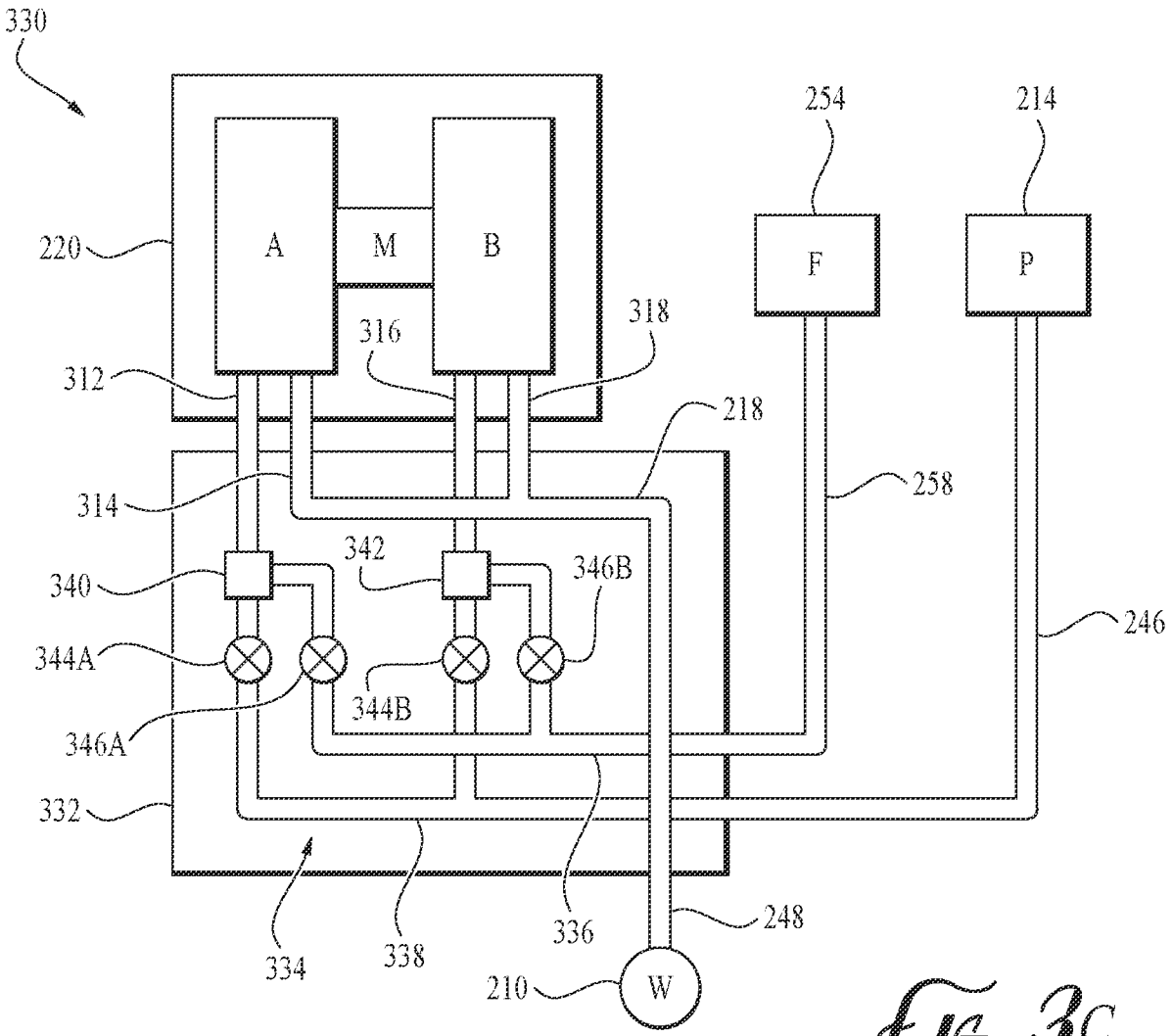

Turning now to FIG. 3C, a fluid network 330 for a pumping unit is described. In some embodiments, the fluid network 330 can comprise a pumping unit, a fluid manifold 332, a supply line 246, a supply line 258, and a high pressure line 248. The fluid network 330 can share similar parts to previous embodiments that may likewise share the same reference numbers. The fluid manifold 332, e.g., the missile, includes a dual low pressure manifold 334 and the high pressure manifold 218. The dual low pressure manifold 334 comprising a clean manifold 336 coupled via a supply line 258 to the clean blender 254 and a dirty manifold 338 coupled via a supply line 246 to the dirty blender 214. The clean manifold 336 and the dirty manifold 338 can be coupled to the pump 220A by a first connector block 340 and a first inlet arm 312. The clean manifold 336 and the dirty manifold 338 can be coupled to the pump 220B by a second connector block 342 and a second inlet arm 316. An isolation valve 344A, 346A can be located on a connector branch between the dirty manifold 338 and clean manifold 336 and the first connector block 340. An isolation valve 344B, 346B can be located on a connector branch between the dirty manifold 338, the clean manifold 336, and the second connector block 342. The first discharge arm 314 and second discharge arm 318 can be fluidically coupled to the high pressure manifold 218. A high pressure line 248 can fluidically couple the high pressure manifold 218 to the wellbore 210. Although one pumping unit, e.g., pumping unit 220, is illustrated coupled to the manifold 332, it is understood that there may be 1, 2, 3, 4, 5, 6, 7, 8, 9, 10, or any number of pumping units coupled to the manifold 332 via corresponding inlet arms and discharge arms.

During pumping operations, exemplary fluid network 330 can feed the pumping unit 220 either a clean fluid, a dirty fluid, or a blend of clean and dirty fluid via the dual manifold 334. The pumping unit 220 can receive clean fluid from the clean blender 254 via the low pressure manifold 336. The pumping unit 220 can receive either clean fluid or dirty fluid from the low pressure manifold 338 coupled to the dirty blender 214. The controller within the control center 236 can blend the clean fluid from the clean manifold 336 with dirty fluid from the dirty manifold 338 by operating the isolation valves 344A, 346A, 344B, and 346B. For example, the controller can decrease the concentration of the proppant entering the inlet arm 316 via the connector block 342 by partially closing the isolation valve 344B connected to the dirty manifold 338 to decrease the flowrate of dirty fluid, e.g., proppant slurry. In some embodiments, the controller can increase the opening valve of the isolation valve 346B coupled to the clean manifold 336 to increase the flowrate of clean fluid to compensate for the decrease in the flowrate of dirty fluid. The fluid network 330 can deliver high pressure fluid from the pumping unit 220 to the wellbore 210 via the high pressure manifold 218. As previously described, the unit controller can be calibrated for dual mode and the pumping unit 220 can be operating in dual mode, e.g., both pump A and pump B operating. If one of the pumps of the pumping unit 220 needs to be shut down due to decrease in pumping performance, the controller within control center 236 can direct the pumping unit 220 to ramp down and stop the pumping operation. The effected pump, for example pump 220B, can be isolated from the fluid manifold 310 and disconnected from the motor 220M. For example, an isolation valve on the inlet arm 316 can be closed to isolate the pump 220B from the low pressure manifold 216. An isolation valve on the discharge arm 318 can be closed to isolate the pump 220B from the high pressure manifold 218. The controller with in the control center 236 can recalibrate the unit controller of pumping unit 220 in single mode and can restart the pumping unit 220 with the motor 220M powering the pump 220A while the pump 220B remains idle.

In some embodiments, the controller can direct the fluid network 330 to flush a pump before isolating the pump from the fluid network 330. Using the prior example of pump 220B, the controller can close the isolation valve 344B coupled to the dirty manifold 338 and fully open isolation valve 346B coupled to the clean manifold 336 to flush all of the proppant slurry from the pump 220B. This flushing operation can occur during the pumping operation, as the pumping unit 220 is ramping down, e.g., decreasing the flowrate, or operating at a decreased value of flowrate. After the flushing operation, the controller can isolate the pump 220B, shut down the pumping unit 220, disconnect the motor 220M from the pump 220B, and resume the pumping operation with pump 220A.

Figure 3D:
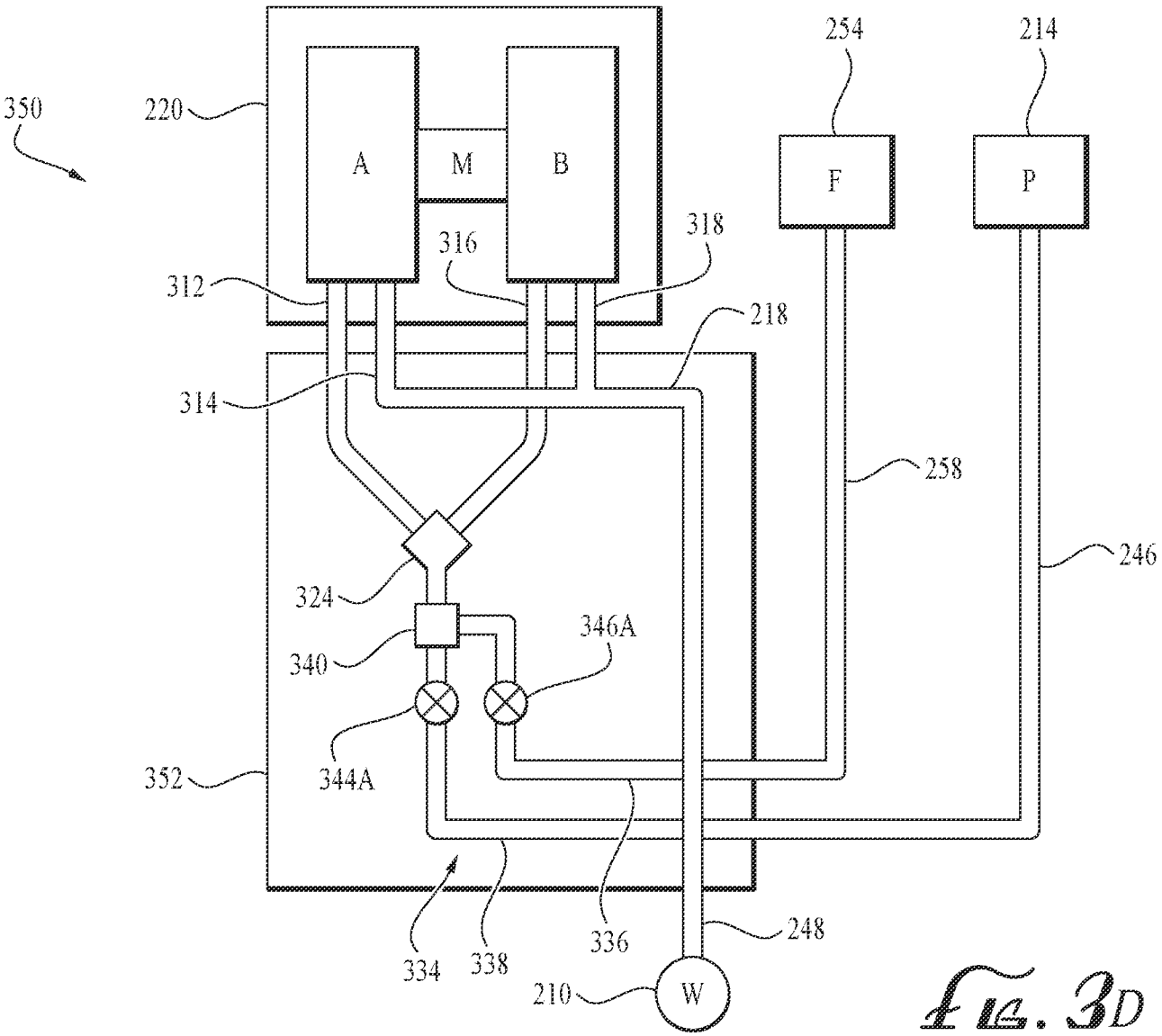

Turning now to FIG. 3D, a fluid network 350 for a pumping unit is described. In some embodiments, the fluid network 350 can comprise a pumping unit, a fluid manifold 352, a supply line 246 of dirty fluid, a supply line 258 of clean fluid, and a high pressure line 248. The fluid network 350 can share similar parts to previous embodiments that may likewise share the same reference numbers. The fluid manifold 352, e.g., the missile, includes a dual low pressure manifold 334 and the high pressure manifold 218. The dual low pressure manifold 334 comprises a clean manifold 336 coupled via a supply line 258 to the clean blender 254 and a dirty manifold 338 coupled via a supply line 246 to the dirty blender 214. The clean manifold 336 and the dirty manifold 338 can be coupled to the pumping unit 220 by a first connector block 340 and a wye-block 324. The wye-block 324 can be coupled to the pump 220A by a first inlet arm 312 and to the pump 220B by the second inlet arm 316. An isolation valve 344A, 344B can be located on a connector branch between the dirty manifold 338 and clean manifold 336 and the first connector block 340. The first discharge arm 314 and second discharge arm 318 can be fluidically coupled to the high pressure manifold 218. A high pressure line 248 can fluidically couple the high pressure manifold 218 to the wellbore 210. Although one pumping unit, e.g., pumping unit 220, is illustrated coupled to the fluid manifold 352, it is understood that there may be 1, 2, 3, 4, 5, 6, 7, 8, 9, 10, or any number of pumping units coupled to the fluid manifold 352 via corresponding inlet arms and discharge arms.

During pumping operations, exemplary fluid network 350 can feed the pumping unit 220 either a clean fluid, a dirty fluid, or a blend of clean and dirty fluid via the dual manifold 334 and wye-block 324. The pumping unit 220 can receive clean fluid from the clean blender 254 via the low pressure manifold 336. The pumping unit 220 can receive either clean fluid or dirty fluid from the low pressure manifold 338 coupled to the dirty blender 214. The controller within the control center 236 can blend the clean fluid from the clean manifold 336 with dirty fluid from the dirty manifold 338 by operating the isolation valves 344A, 346A, 344B, and 346B. For example, the controller can decrease the concentration of the proppant to pump 220A and pump 220B via the wye-block 324 by partially closing the isolation valve 344A connected to the dirty manifold 338 to decrease the flowrate of dirty fluid, e.g., proppant slurry. In some embodiments, the isolation valve 346A coupled to the clean manifold 336 can be operated to a greater open value by the controller to compensate for the decrease in flowrate of the dirty fluid. The fluid network 350 can deliver high pressure fluid from the pumping unit 220 to the wellbore 210 via the high pressure manifold 218. As previously described, the unit controller can be calibrated for dual mode and the pumping unit 220 can be operating in dual mode, e.g., both pump A and pump B operating. If one of the pumps of the pumping unit 220 needs to be shut down due to decrease in pumping performance, the controller within control center 236 can direct the pumping unit 220 to ramp down and stop the pumping operation. In some embodiments, the controller can initiate a flushing operation previously described to flush the proppant slurry from the pump 220A and pump 220B before disconnecting one of the pumps. The effected pump, for example pump 220B, can be isolated from the fluid manifold 352 and disconnected from the motor 220M. For example, an isolation valve on the inlet arm 316 can be closed to isolate the pump 220B from the dual manifold 334. An isolation valve on the discharge arm 318 can be closed to isolate the pump 220B from the high pressure manifold 218. The controller within the control center 236 can recalibrate the unit controller of pumping unit 220 in single mode and can restart the pumping unit 220 with the motor 220M powering the pump 220A while the pump 220B remains idle.

Figure 3E:
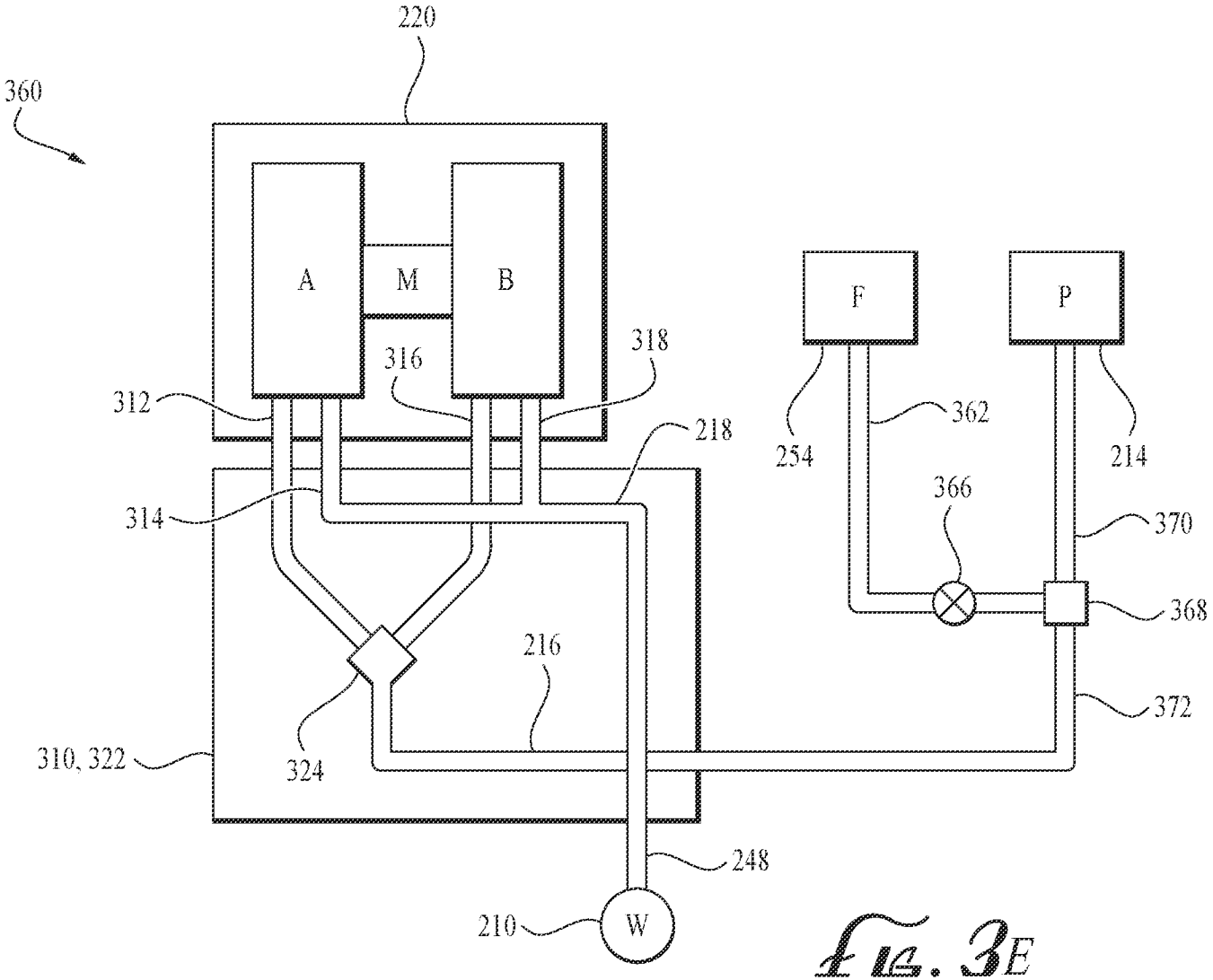

Turning now to FIG. 3E, an exemplary fluid network 360 for a pumping unit is described. In some embodiments, a fluid network 360 can comprise a pumping unit, a fluid manifold (e.g., fluid manifold 310), a supply line 372, and a high pressure line 248. The fluid manifold of fluid network 360 can be either fluid manifold 310 of FIG. 3A or fluid manifold 322 of FIG. 3B. As previously described, fluid manifold, e.g., fluid manifold 310, 322, comprises the low pressure manifold 216 and the high pressure manifold 218. The low pressure manifold 216 can be coupled to the supply line 372 and can receive a blended proppant slurry that comprises a portion of the clean fluid from the clean blender 254 and a portion of the dirty fluid from the dirty blender 214. The blended proppant slurry can be the clean fluid from the clean blender 254 via connector extension 362 and dirty fluid from the dirty blender 214 via connector line 370. The clean fluid and dirty fluid can be combined at the block 368. The controller within control center 236 can control the flowrate and proppant concentration of the blended proppant slurry with a control valve 366 and by controlling the flowrate of the clean blender 254 and the flowrate of the dirty blender 214. For example, the controller can increase the proppant concentration of the proppant slurry by decreasing the flowrate of the clean fluid from the connector extension 362 by closing the control valve 366 and/or decreasing the flowrate of clean fluid from the clean blender 254. Although one pumping unit, e.g., pumping unit 220, is illustrated coupled to the fluid manifold 310, it is understood that there may be 1, 2, 3, 4, 5, 6, 7, 8, 9, 10, or any number of pumping units coupled to the fluid manifold 310 via corresponding inlet arms and discharge arms.

During pumping operations, exemplary fluid network 360 can feed the pumping unit 220 a clean fluid from the clean blender 254, a dirty fluid from the dirty blender 214, or a blended proppant slurry from both the clean blender 254 and the dirty blender 214 via a low pressure manifold 216. As previously described, the unit controller can be calibrated for dual mode and the pumping unit 220 can be operating in dual mode, e.g., both pump A and pump B operating. The fluid network 360 can deliver high pressure fluid from the pumping unit 220 to the wellbore 210 via the high pressure manifold 218. If one of the pumps of the pumping unit 220 needs to be shut down due to a decrease in pumping performance, the controller within control center 236 can direct the pumping unit 220 to ramp down and stop the pumping operation. The effected pump, for example pump 220B, can be isolated from the fluid manifold 310 and disconnected from the motor 220M. For example, an isolation valve on the inlet arm 316 can be closed to isolate the pump 220B from the low pressure manifold 216. An isolation valve on the discharge arm 318 can be closed to isolate the pump 220B from the high pressure manifold 218. The controller with in the control center 236 can recalibrate the unit controller of pumping unit 220 in single mode and can restart the pumping unit 220 with the motor 220M powering the pump 220A while the pump 220B remains idle.

Figure 4:
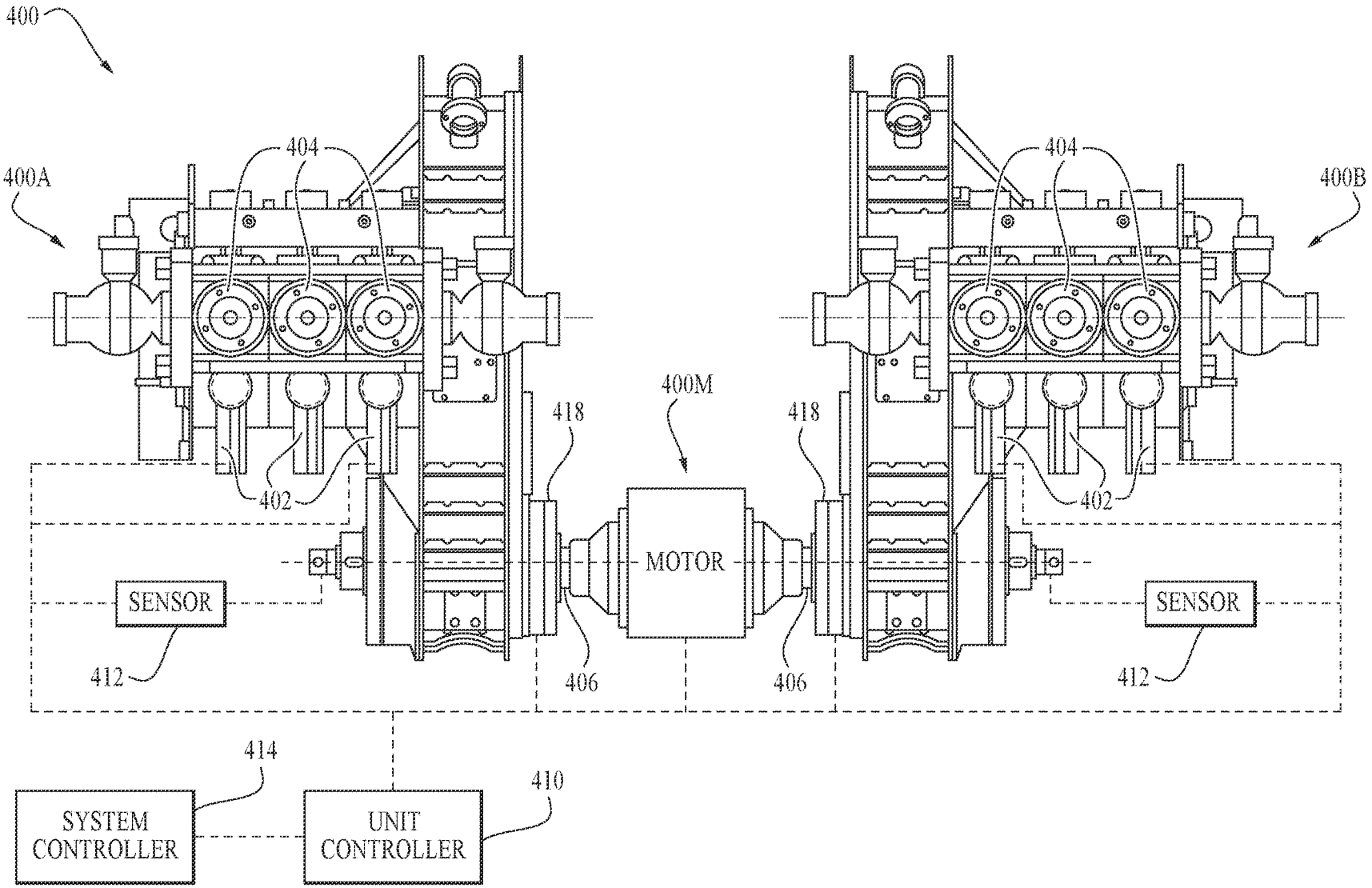
FIG. 4 is a side view of exemplary pumping equipment according to an embodiment of the disclosure.

A pump with a decrease in pumping performance can be disconnected from the prime mover of the pumping unit. Turning now to FIG. 4, a front view of an exemplary pumping system 400 of a pumping unit is described. The pumping system 400 can be an embodiment of the pumping system 138 of FIG. 1 and the pumping unit 220 of FIG. 2. In some embodiments, the pumping system 400 comprises a prime mover 400M can be releasably coupled to a first pump 400A and releasably coupled to a second pump 400B. The prime mover 400M can be an embodiment of a prime mover 230 of FIG. 2 and referred to as motor 400M. The pump 400A can be a first pump, e.g., first pump 232 of FIG. 2. The pump 400B can be a second pump, e.g., second pump 234 of FIG. 2. Hereinafter, the pump 400A will refer to the first pump powered by the motor 400M and pump 400B will refer to the second pump powered by the motor 400M of the pumping system 400.

The pump 400A and the pump 400B can be a positive displacement pump with a valve system 402. In some embodiments, the pump 400A and the pump 400B can comprise multiple chambers 404 with plungers driven by a drive shaft and/or crankshaft 406 with the valve system 402 comprising intake valves and discharge valves. For example, each of the pumps, e.g., pump 400A, can include three chambers 404 with a plunger (not shown) reciprocating within each chamber and mechanically coupled to a crankshaft 406. Each chamber may include a suction valve and a discharge valve that operate with each stroke of the plunger. The suction valve fluidically couples the chamber to a low pressure manifold, e.g., manifold 216 of FIG. 2. The reciprocating plunger can draw in fluid through the suction valve, pressurize the fluid within the chamber, and discharge the fluid through a discharge valve that is fluidically coupled to a high pressure manifold, e.g., manifold 218 of FIG. 2. The drive shaft and/or crankshaft 406 can be rotationally and releasably coupled to the motor 400M, e.g., an electric motor that drives the crankshaft 206 for powering the pump 400A and/or pump 400B. Although the motor 400M is described as an electric motor, it is understood that the motor 400M could be an internal combustion motor or turbine engine. Although the pump 400A, 400B is described as a positive displacement pump, it is understood that the pump can be a centrifugal pump, a multistage centrifugal pump, a turbine pump, a rod pump, a progressive cavity pump, or any combination thereof. Although the pump 400A and pump 400B are described as the same type of pump, it is understood that the pump 400A can be a different type and/or model than pump 400B.

The prime mover, e.g., motor 400M, can be releasably coupled to the drive shaft and/or crankshaft 406 by a decoupler mechanism 418. The decoupler mechanism can include an coupling actuator and a positioning sensor communicatively connected to the controller. The decoupler mechanism can be configured to engage or disengage the motor 400M to the drive shaft and/or crankshaft 406 as will be described hereinafter.

The motor 400M, e.g., prime mover, can be communicatively coupled to a unit controller 410, e.g., unit controller of FIG. 1. The unit controller 410 can control the torque and speed of the motor 400M. As previously disclosed, the unit controller 410 can be calibrated to measure, calculate, and communicate the pumping operation of both pumps, e.g., pump 400A and pump 400B operating in the dual pump mode or the pumping operation of a single pump, e.g., pump 400A, in the single pump mode. For example, the unit controller 410 can report the flowrate of the pumping unit 400 in dual mode is double the flowrate of the pumping unit in single mode. Said another way, the unit controller can determine a motor speed (rpm) and acceleration (rpm/sec) in single mode that is double the a motor speed (rpm) and acceleration (rpm/sec) of dual mode to match or obtain a target (e.g., setpoint) total desired rate (bpm) and change in rate (bpm/sec). Similarly, the unit controller can calculate an increase or decrease rate of flowrate in dual mode that is double the rate of flowrate change in single mode. The unit controller 410 can be coupled to a set of sensors 412 to measure periodic datasets indicative of the pumping operation. In some embodiments, the set of sensors 412 can include pressure sensors, flowrate sensors, positional sensors, voltage sensors, or combinations thereof. The set of sensors 412 can include a positional sensor, e.g., a hall-effect sensor, configured to detect whether the pump 400A, 400B are operating and/or the speed at which each of the pumps 400A, 400B are operating. The sensors 412 can include a voltage sensor configured to detect the speed and/or torque of the motor 400M. The sensors 412 can include one or more positional sensors configured to detect if the decoupler mechanism is coupled or decoupled.

In some embodiments, the unit controller 410 can be communicatively coupled to the system controller 414 within the control center, e.g., control center 236 of FIG. 2. The system controller 414 can direct a pumping operation utilizing the pumping system 400 via the unit controller 410. The system controller 414 can receive periodic datasets (from the set of sensors 412) of the pumping operation via the unit controller 410.

Figure 5A:
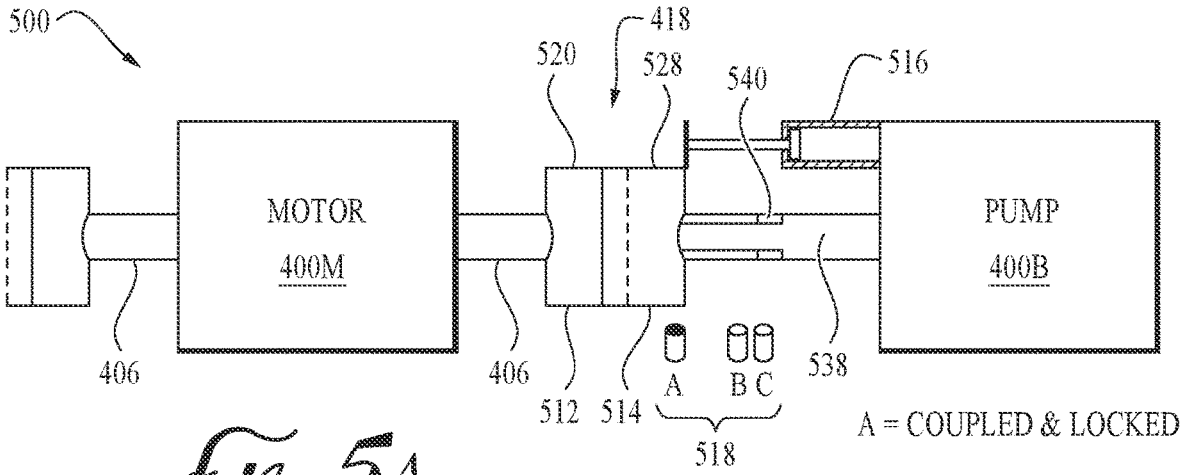
FIG. 5A-SC are side views of a decoupling mechanism of a pumping unit according to an embodiment of the disclosure.
Figure 5B:
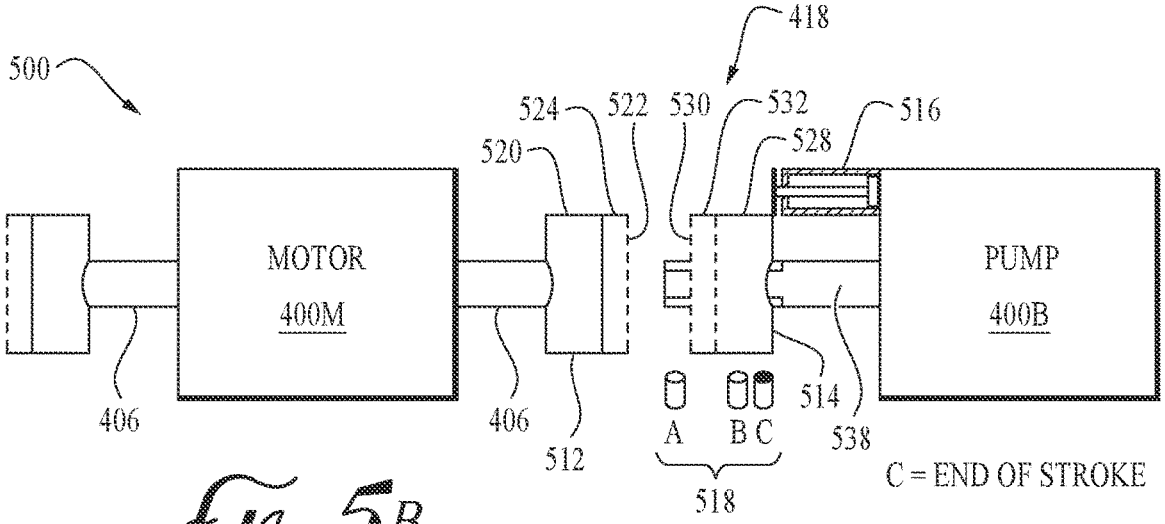
FIG. 5D is a side view of a decoupling mechanism of a pumping unit according to another embodiment of the disclosure.
FIG. 5E is a partial section view of the shaft of the decoupling mechanism of a pumping unit according to another embodiment of the disclosure.
Figure 5C:
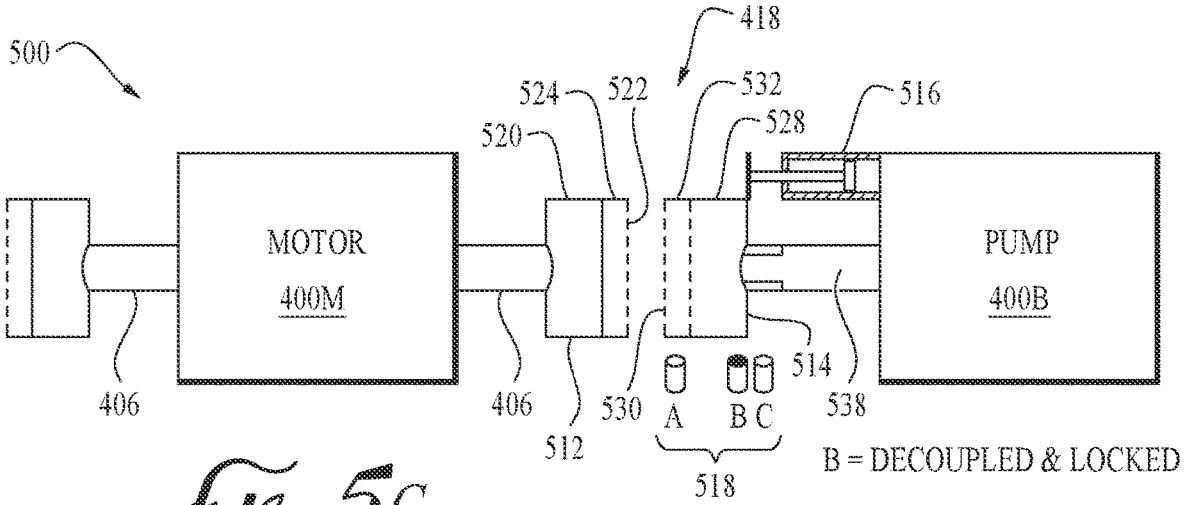

Turning now to FIG. 5A-5C, an illustration of a pump system 500 with a decoupler mechanism is described. In some embodiments, the decoupler mechanism 418 comprises a static element 512, a dynamic element 514, an actuator 516, and a set of positional sensors 518. The static element 512 can be a generally cylinder shape with an outer surface 520, a front face 522, and a set of protrusions, e.g., teeth. The static element 512 can be mechanically coupled to the drive shaft 406 of the motor 400M and configured to transmit torque and rotational motion to the mating dynamic element 514. The dynamic element 514 can be a generally cylinder shape with an outer surface 528, a front face 530, and a back face. The dynamic element 514 can be slidingly mounted on a drive shaft 538 of the pump 400B. The front face 530 of the dynamic element 514 can engage a set of splines 540 on the drive shaft 538. The front face 530 of the dynamic element 514 can include a set of protrusions 532 configured to transmit torque and rotational motion from the mating protrusions 524 of the static element 512. The front face 530 of the dynamic element 514 can be configured to transmit torque and rotational motion to the drive shaft 538 via the splines 540. The actuator 516 can comprise an extender mandrel, a housing, and an extension-retraction mechanism and can couple the dynamic element 514 to the pump housing of the pump 400B. The extender mandrel can be coupled to the dynamic element 514 and the extension retraction mechanism. The housing can be coupled to the pump housing of the pump 400B and the extension-retraction mechanism. The actuator 516 can have an extended position, a retracted position, and a locked position. The actuator 516 can be configured to position the dynamic element 514 into engagement with the static element 512 in the extended position as shown in FIG. 5A. In some embodiments, the extender mandrel may not be coupled to the dynamic element 514. For example, the extender mandrel may be configured to urge or move the dynamic element 514 into a position, for example, the coupled position, then return to a home position.

The extension-retraction mechanism within the actuator 516 can operate the decoupler mechanism 418 from a coupled configuration to a decoupled configuration. In some embodiments, the extension-retraction mechanism can comprise a first volume of fluid, a pump, and a second volume of fluid. For example, an extender mandrel within housing can be urged outward from the housing by transferring fluid from the first volume to the second volume by the pump. In some embodiments, the extender mandrel within the housing can be extended by an electric motor turning a gearing system mechanically coupled to the mandrel. In some embodiments, the extender mandrel can be a threaded rod that is extended/retracted from the housing by an electric motor. The extension-retraction mechanism can be controlled to move in a first direction, e.g., to a coupled configuration, and move in a second direction, e.g., to a decoupled configuration, by the unit controller 410 of FIG. 4. In some embodiments, the unit controller 410 is electrically coupled to the actuator 516 to provide voltage and power to the extension-retraction mechanism.

The set of positional sensors 518 can provide feedback of the position of the dynamic element 514 and thus the configuration of the decoupler mechanism 418 to the unit controller 410. Each of the sensors within the set of positional sensors 518 can be a magnetic sensor, e.g., a hall-effect sensor, configured to sense the position of the dynamic element 514. As illustrated in FIG. 5A, the decoupler mechanism 418 can be in the coupled configuration with the dynamic element 514 coupled to the static element 512 with the protrusions 524 of the static element 512 mated with the protrusions 532 of the dynamic element 514. The position of the dynamic element 514 in the coupled configuration can activate the sensor 518A, e.g., the sensor 518A can return a positive value. In some embodiments, the extension mandrel of the actuator 516 can lock or hold the dynamic element 514 in the coupled position. In some embodiments, the extension mandrel of the actuator 516 can position dynamic element 514 in the coupled configuration, the extension mandrel can return to a home position, and a latching mechanism can lock or hold the dynamic element 514 in the coupled position.

In some embodiments, the unit controller 410 of the pumping unit 400 can determine if the pump 400B is coupled to the motor 400M by receiving a signal, e.g., a positive value, from sensor 518A. In some embodiments, the unit controller 410 can calibrate or recalibrate the pumping unit 400 in single mode or dual mode in response to the signal from sensor 518A.

As illustrated in FIG. 5B, the actuator 516 of the decoupler mechanism 418 can retract the dynamic element 514 away from the static element 512. The dynamic element 514 can be decoupled from the static element 512 with the protrusions 524 of the static element 512 decoupled or unmated with the protrusions 532 of the dynamic element 514. The actuator 516 can move the dynamic element 514 to the end of the stroke of the extend-retract mechanism that can activate the sensor 518C, e.g., the sensor 518C can return a positive value. The unit controller 410 can actuate the decoupler mechanism 418 to move the dynamic element 514 to an end of stroke position of the actuator 516 and receive feedback of the position of the dynamic element 514 from sensor 518C. In some embodiments, the extension mandrel of the actuator 516 can extend and couple to the dynamic element 514 and retract the dynamic element 514 to the end of stroke position.

As illustrated in FIG. 5C, the actuator 516 of the decoupler mechanism 418 can position the dynamic element 514 in a decoupled and locked position with respect to the static element 512. The dynamic element 514 can be in a decoupled configuration with the protrusions 524 of the static element 512 decoupled or unmated with the protrusions 532 of the dynamic element 514. The actuator 516 can move the dynamic element 514 to a decoupled and locked position that can activate the sensor 518B, e.g., the sensor 518B can return a positive value. In some embodiments, the actuator 516 can lock or hold the dynamic element 514 in the decoupled position. In some embodiments, the actuator 516 can move, e.g., extend, the dynamic element 514 from the end of stroke position to the decoupled position, the actuator 516 can release from the dynamic element 514, the actuator 516 can return to a home position, and a latching mechanism can lock or hold the dynamic element 514 in the decoupled position.

Figure 5D:
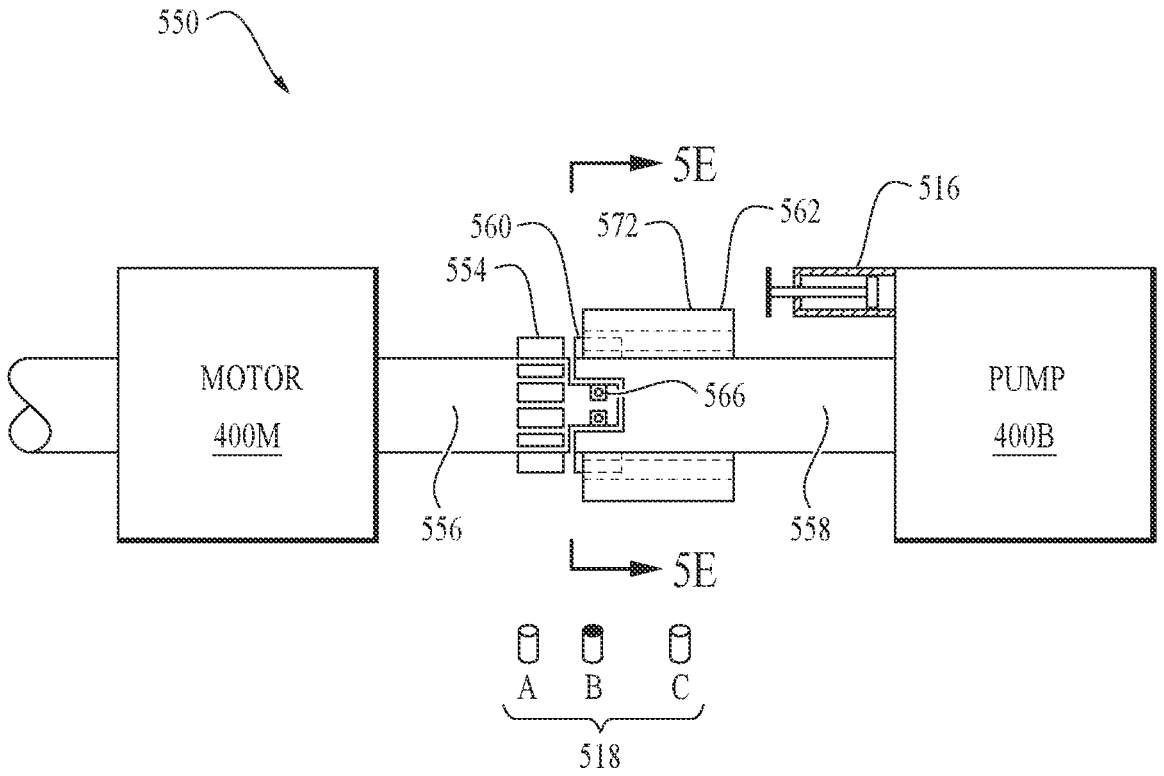
Figure 5E:
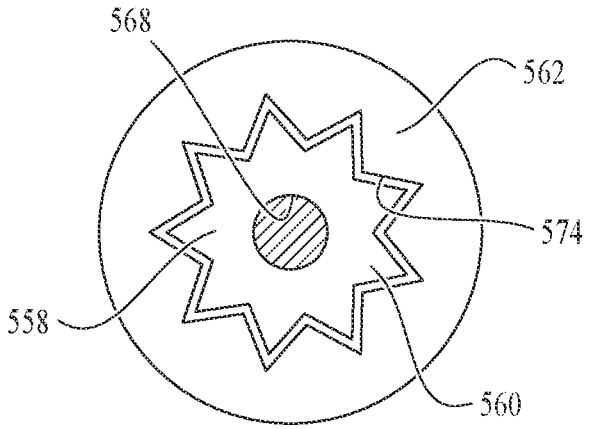

Turning now to FIG. 5D, an embodiment of the decoupler mechanism 550 is described. In some embodiments, the drive shaft 556 of the motor 400M can remain rotationally coupled to a drive shaft 558 of the pump 400B when coupled or decoupled. The decoupler mechanism 550 comprises a torque coupling 562 slidingly mounted on the drive shaft 558 of the pump 400B. The torque coupling can be a generally cylinder shape with an outer surface 572 and an inner surface with a set of splines 574. The drive shaft 558 of the pump 440B can include a set of splines 560 configured to slidingly mate with the set of splines 574 on the torque coupling 562. The drive shaft 556 of the motor 400M can include a bearing assembly 566 and a set of splines 554. The bearing assembly 566 can be rotationally mated with a bearing race 568 within the drive shaft 558 of the pump 400B. The set of splines 554 on the drive shaft 556 of the motor 400M can be configured to engage the set of splines 574 inside the torque coupling 562. In a coupled position, the set of splines 574 within the torque coupling 562 can be engaged with the splines 554 on the drive shaft 556 of the motor 400M and the splines 560 on the drive shaft 558 of the pump. In the coupled position, the torque coupling 562 can be configured to transmit torque and rotational motion from the drive shaft 556 of the motor 400M to the drive shaft 558 of the pump 400B. The sensor 518A of the set of sensors 518 can return an active signal. In some embodiments, the unit controller 410 may configure the pumping unit in a dual mode in response to the sensor 518A returning an active signal. The actuator 516 can be configured to position the torque coupling 562 in a coupled position or a decoupled position. In some embodiments, the extender mandrel may not be coupled to the torque coupling 562. For example, the extender mandrel may be configured to urge or move the torque coupling 562 into a position, for example, the coupled position, then return to a home position.

As shown in FIG. SD, the actuator 516 can move the torque coupling 562 to a decoupled position and then return to a home position. In the decoupled position, the torque coupling 562 can be engaged with the set of splines 560 on the drive shaft, disengaged from the set of splines 554 on the drive shaft 556 of the motor 400M, and parked on the drive shaft 558 of the pump 400B. The motor 400M can remain rotationally coupled to the drive shaft 558 of the pump 400B with the bearing assembly 566 but torque and rotational motion may not be transferred to the drive shaft 558 of the pump 400B. The sensor 518B of the set of sensors 518 can return an active signal. In some embodiments, the unit controller 410 may configure the pumping unit in a single mode in response to the sensor 518B returning an active signal.

In some embodiments, the unit controller 410 of the pumping unit 400 can determine the pump 400B is decoupled to the motor 400M by receiving a signal, e.g., a positive value, from sensor 518B. In some embodiments, the unit controller 410 can calibrate or recalibrate the pumping unit 400 from dual mode to single mode in response to the signal from sensor 518B.

A wellbore servicing operation can utilize a fracturing spread to fracture one or more formations. As described in FIG. 2, the fracturing spread can comprise a plurality of pumping units, e.g., pumping unit 220, configured to place a wellbore treatment fluid, e.g., a proppant slurry, into a wellbore, e.g., wellbore 210. The fracturing spread, e.g., fracturing spread 200, can pump the wellbore treatment fluid into a formation, e.g., formation 132 of FIG. 1, per a pumping schedule designed to fracture the formation and deposit a proppant agent, e.g., sand, into the resultant fractures. A controller can direct the plurality of fracturing units comprises one or more blenders, e.g., dirty blender 214, and the plurality of pumping units, e.g., dirty pumping units 212, per a pumping schedule to place the wellbore treatment, e.g., the proppant slurry, into the formation, e.g., formation 132, within the wellbore, e.g., wellbore 210. Each of the plurality of pumping units within the fracturing spread can be operating at any period of time in accordance with job requirements. For example, the dirty pumping units 212 shown in FIG. 2 can be operating in accordance with a pumping schedule that is associated with a stage, e.g., an interval, of an overall fracturing operation. For example, during the stage the dirty pumping units 212 may need to operate at a designated period of time or to place a designated volume of wellbore treatment fluid at a predetermined slurry concentration, pumping pressure, and flowrate.

In some scenarios, the pumping units of the fracturing spread can utilize fluid network 300 described in FIGS. 3A and 3B to receive fluid directly from a blender. The controller can direct the fracturing spread to deliver a designated concentration of proppant per the pumping schedule to the wellbore with the dirty blender 214 or with a combination of the dirty blender 214 and the clean blender 254. The controller can adjust the concentration of proppant based on periodic datasets from one or more sensors coupled to or located within the wellbore.

In some scenarios, the pumping units of the fracturing spread can utilize fluid network 330 or fluid network 350 described in FIGS. 3C and 3D to deliver a blended wellbore treatment fluid. The controller can direct the fracturing spread to deliver a designated concentration of proppant per the pumping schedule to the wellbore with one or more isolation valves, e.g., isolation valve 344A, 346A, and/or by varying the flowrates of the dirty blender 214 and the clean blender 254. The controller can adjust the concentration of proppant based on periodic datasets from one or more sensors coupled to or located within the wellbore.

In some scenarios, the pumping units of the fracturing spread can utilize fluid network 360 described in FIG. 3E to deliver a blended wellbore treatment fluid. The controller can direct the dirty blender 214 and the clean blender 254 to deliver a designated concentration of proppant per the pumping schedule to the pumping units with one or more isolation valves, e.g., control valve 366, and/or by varying the flowrates of the dirty blender 214 and the clean blender 254. The controller can adjust the concentration of proppant based on periodic datasets from one or more sensors coupled to or located within the wellbore.

Figure 6A:
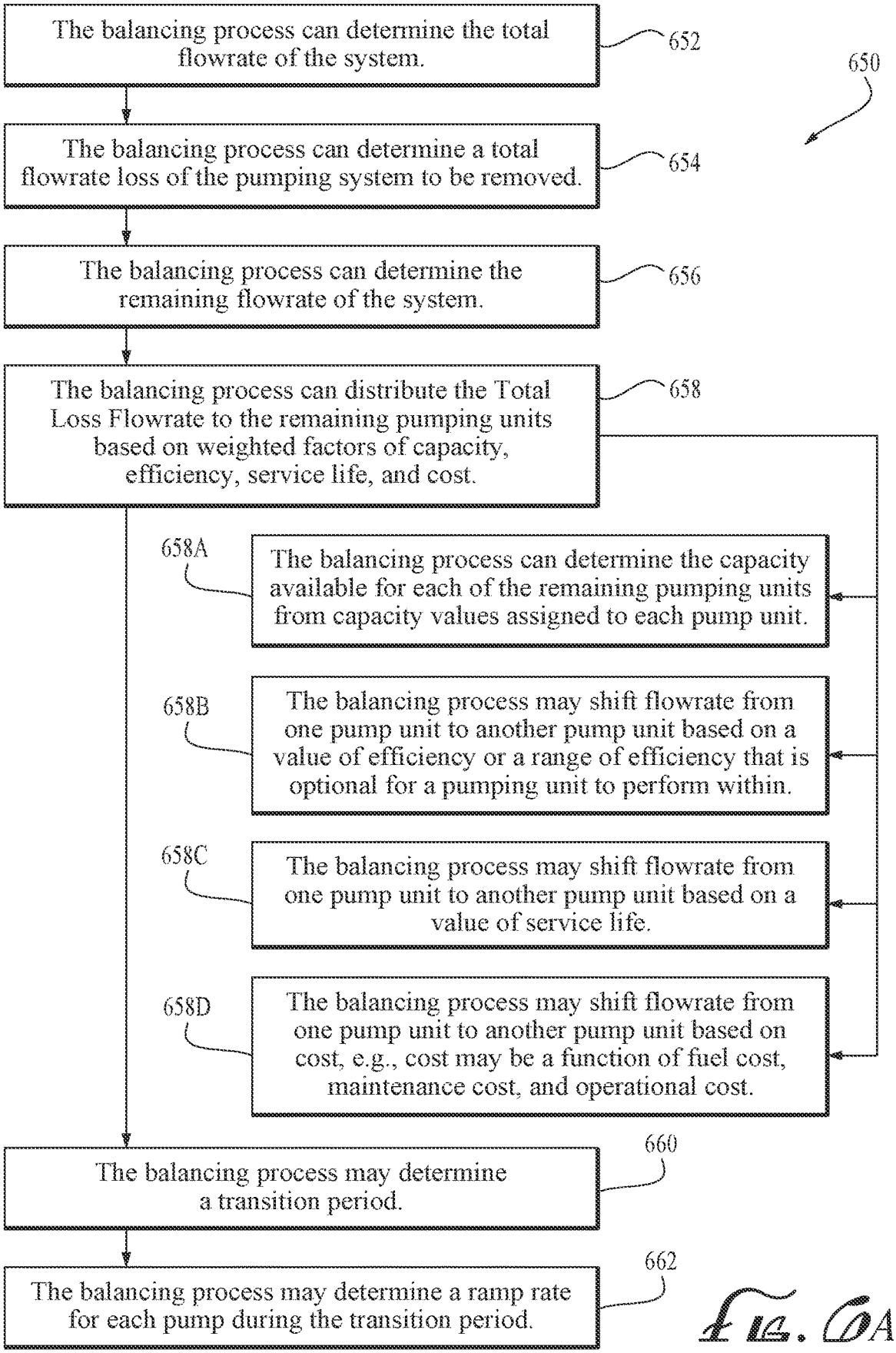
FIG. 6A is a logic block diagram of a method of balancing pump loads during a pumping operation according to an embodiment of the disclosure.
Figure 6B:
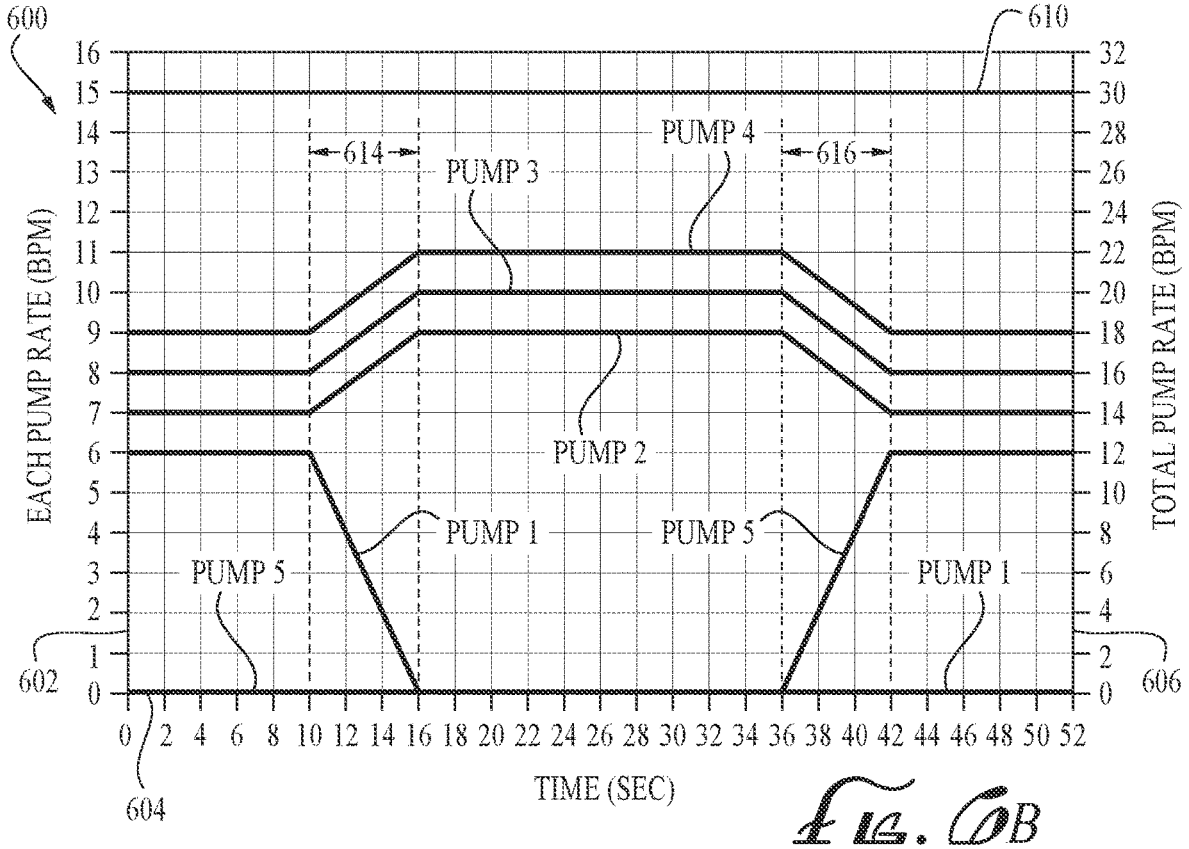
FIG. 6B-6D are exemplary graphs of balancing pump loads during a pumping operation according to an embodiment of the disclosure.

During the performance of a wellbore servicing operations, one or more pumps, e.g., pump 220B of pumping unit 220, may need to cease operation and in some cases be replaced. Referring to exemplary pumping system 400 in FIG. 4 that is a simplified pumping unit for illustration purposes. The system controller 414 may receive an indication of reduced pumping performance, for example, may detect a pump 400B experiencing overheating or a decrease in pumping performance per the set of sensors 412 via the unit controller 410. The system controller may execute a process for balancing the pumping loads of the pumping operation with one or more pumping units within the fracturing spread. Turning now to FIGS. 6A and 6B, an exemplary graph 600 of a pumping operation is used to illustrate a balancing process 650 for replacing a pump during a pumping operation. The exemplary graph 600 includes four pumps operating at various pumping rates of 6-9 barrels per minute (BPM) for a total pumping rate of 30 BPM as indicated by line 610. The graph 600 includes a primary axis 602 for individual pumping rate (BPM) and a secondary axis 606 for total pumping rate (BPM) with an independent axis 604 for time (SEC). In the exemplary graph 600, a first pumping unit (labeled PUMP 1) is operating at 6 BPM, a second pumping unit (PUMP 2) is operating at 7 BPM, a third pumping unit (PUMP 3) is operating at 8 BPM, and a fourth pumping unit (PUMP 4) is operating at 9 BPM. The system controller, e.g., system controller 414, can designate the pumping rates for each pumping unit based on operational factors, e.g., a number of weighted factors, such as, capacity, capability, efficiency, service life, cost, and other factors designated by the user. The capacity of a pumping unit can be the operational capacity, e.g., pumping rate and pressure, of the pump and/or prime mover. The capability of a pumping unit can be the ability to connect to a fluid network and pump a specific fluid type, for example, a liquified gas fracturing system. The efficiency of a pumping unit can be determined based on the instantaneous hydraulic power and instantaneous power provided by the prime mover. The service life of the pumping unit can be a number of hours of operation remaining before required maintenance. The cost of the pumping unit can be determined by a function of the cost of the fuel and maintenance of the pumping unit, for example, the cost of diesel. For example in FIG. 6B, the system controller may set the pumping rate of PUMP 4 at 9 BPM because of a high efficiency/capability score in combination with a high service life score. Likewise, the system controller may set the pumping rate of PUMP 1 at 6 BPM because of a low service life score.

With reference to FIG. 2, the system controller within the control center 236 may receive an indication of reduced pumping performance, for example, an indication of an operational caution, e.g., overheating, or an indication that service is required, e.g., a reduction in pressure, from PUMP 1 (pumping unit 220). The system controller can determine a new pumping rate for PUMP 2 (pumping unit 222), PUMP 3 (pumping unit 224), and PUMP 4 (pumping unit 226) based on the weighted factors of capacity, capability, efficiency, service life, cost, or combinations thereof. The system controller may determine a first transition period 614 to reduce the pumping rate of PUMP 1 to zero while simultaneously compensating with the remaining pumping units so that the overall pumping rate does not change. Turning now to FIG. 6A, the system controller may execute a balancing process 650 for flowrate balancing with the following steps. At step 652, the balancing process can determine the total flowrate of the system. The total flowrate of the system can be referred to as the first balanced pump load. From the example of FIG. 6B, the first balance pump load can be from zero to 10 seconds, the first transitional balanced pump load can be from 10 to 16 seconds, the second balanced pump load can be from 16 to 36 seconds, a second transitional balanced pump load can be from 36 to 42 seconds, and a supplemented balanced pump load can be from 42 to 52 seconds. The total flowrate during each of the balanced pump loads, e.g., the first balanced pump load, is represented by line 610 and is 30 BPM. At step 654, the balancing process can determine a total flowrate loss of the pumping system to be removed. From the example of FIG. 6B, Total Loss Flowrate=6 BPM for the removal of PUMP 1. At step 656, the balancing process can determine the remaining flowrate of the system. From FIG. 6B, the Remaining Flowrate=24 BPM. At step 658, the process can determine how to distribute the Total Loss Flowrate of 6

BPM to the remaining pumping units for the second balanced pump load from 16 to 36 seconds. For example, in FIG. 6B, the remaining pumps comprise PUMP 2, PUMP 3, and PUMP 4. The system controller can determine the new pumping rate for each pump based on the weighted factors of capacity, capability, efficiency, service life, and cost. Based on the weighted factors, the first determination step 658A may be capacity. The balancing process can determine the capacity available for each of the remaining pumping units from capacity values assigned to each pumping unit. As the pumping units have a maximum operational capacity, the process can exclude the pumping units within a threshold value of the maximum operational capacity. The second determination step 658B may be based on value of efficiency or a range of efficiency that a pumping unit that is optional for a pumping unit to perform within. In some embodiments, the range of efficiency can be between 50% and 99%, from 60% and 90%, from 70% and 80%, or any range between 40% and 100%. For example, the balancing process may exclude less efficient pumps and transfer flowrate to more efficient pumps. In other scenarios, the process may transfer a greater portion of the flowrate to more efficient pumps and a lessor portion to less efficient pumps. The third determination step 658C may be based on service life. For example, the balancing process may transfer flowrate to pumping units with a greater value of service life remaining. The value of service life can refer to a number of hours of operation remaining before required maintenance. The fourth determination step 658D may be based on cost. For example, the cost of operation may be a fuel cost, for example, a diesel pumping unit may be more expensive to operate than an electric pumping unit. In other scenarios, a first model of pumping unit may be more expensive to operate than a second model of pumping unit. The steps of the balancing process may be determined by the weighting factors selected by the user or the customer and as such the order of the balancing process may change accordingly.

Returning to the example of FIG. 6B, the balancing process may divide the increase in flowrate equally among the remaining pumping units for the second balanced pump load. For example, the remaining pumping units of PUMP 2, PUMP 3, and PUMP 4 may increase a total amount equal to the Total Loss Flowrate of 6 BPM from step 658. The balancing process may divide the 6 BPM equally so that each pump increases an amount of 2 BPM. As a result, PUMP 2 target flowrate increases from 7 BPM to 9 BPM, PUMP 3 target flowrate increases from 8 BPM to 10 BPM, and PUMP 4 target flowrate increases from 9 BPM to 11 BPM.

As used herein, ramp rate can refer to the acceleration/deceleration rate for the pumping unit. Ramps rates can be same or different for each pumping unit. In other words, ramp rate is defined as the rate-of-change of pumping rate (e.g., flowrate of the pump). By controlling an individual ramp rate of each pumping unit simultaneously receiving a pumping rate change, the overall combined flowrate can be a controlled constant. Overall pumping flowrate can be held constant while multiple pumps are simultaneously changing rates as long as the sum of the ramp rates (e.g., positive and negative slopes; increasing and decreasing) is zero.

Returning to the balancing process 650, the balancing process 650 may determine a transition period at step 660 defined as a value of time between a first pump load, e.g., Total flowrate of step 652, and a second pump load, e.g., distribution of flowrate at step 658. The transition period, e.g., transition period 614, may be determined based on the greatest rate change, e.g., PUMP 1. At step 662, the balancing process may determine a ramp rate for each of the pumps during a transition period, e.g., transition period 614, that results in a constant flowrate. Returning to FIG. 6B, at step 660, the balancing process may determine a transition period 614 for the pumping unit to be removed to ramp down, e.g., decrease pumping rate, and the remaining pumping units to ramp up, e.g., increase pumping rate. For example, the transition period 614 is 6 seconds in length, thus the balancing process can set the PUMP 1 rate change at 6 BPM per 6 seconds for a decrease in rate of 1 BPM per second. The balancing process can set the rate change for the remaining three pumps to 2 BPM per 6 seconds for an increase in rate of ⅓ BPM per sec. Thus, the balancing process can set the rate change of flowrate decreasing equal to the total combined ramp rate change of flowrate increasing. The balancing process can determine a ramp rate for each of the pumps so that the total flowrate of the plurality of pumps remains constant, e.g., the transitional balanced pump load.

The balancing process 650 may divide the transition period, e.g., transition period 614 and/or 616, into multiple sequential time steps. For example, transition period 614 can be divided into six transition sub-periods of 1 second duration, e.g., 614A is 1 second, 614B is 1 second, etc. The balancing process 650 can determine a balanced ramp rate within each sub-period, e.g., 614B, so that the total flowrate, e.g., the transitional balanced pump load, remains constant within each sub-period and thus, the flowrate of the plurality of pumps remains constant with the flowrate before the transition period, during the transition period, during each sub-period of the transition period, and after the transition period ends. Although the examples illustrate pumps with constant ramp rate throughout the transition period, it is understood that the transition period may include step changes and/or one or more pumps may return to a constant flowrate before the end of the transition period as long as the flowrate of the plurality of pumps remains constant during each sub-period of the transition period.

In some embodiments, the system controller can direct the unit controller of PUMP 1 to decouple a pump with the decrease in pumping performance. For example, the system controller 414 within the control center 236 can direct the unit controller 410 to activate the decouple mechanism 418 within PUMP 1, e.g., pumping system 400, to decouple the pump 400B, e.g., pump 220B of pumping unit 220, from the motor 400M, e.g., motor 220M. In this example, the pump 400B with the decrease in pumping performance can be decoupled from the motor 400M while the other pump 400A with normal operation remains coupled to the motor 400M. PUMP 1 can be returned to the pumping operation with pump 400A operational and pump 400B decoupled or non-operational. In some embodiments, the system controller can direct the isolation valves within a fluid manifold, e.g., fluid manifold 310, to close. For example, the system controller within the control center 236 can direct the isolation valves within the inlet arm 316 and discharge arm 318 of fluid network 300 coupled to the non-operational pump to close.

In some embodiments, the system controller can isolate PUMP 1 from the fracturing spread and replace PUMP 1 with another pumping unit, for example, PUMP 5. A pumping unit, e.g., PUMP 5, can be held in reserve, e.g., in a non-operational state, in case of a pumping unit failure. In the example of FIG. 6B, PUMP 5, e.g., a pumping unit, is held in reserve, e.g., a non-operational state, until the system controller removes PUMP 1 from the pumping operation. The system controller can utilize the balancing process to replace the flowrate loss of PUMP 1 with PUMP 5 for the supplemental balanced pump load beginning at 42 seconds.

In some embodiments, the balancing process can utilize a second transition period 616 to add a pumping unit to the pumping operation. The balancing process may determine a ramp rate for each of the pumps during the second transition period 616. Returning to FIG. 6B, the balancing process may determine a second transitional balanced pump load for a second transition period 616 for the new pumping unit, PUMP 5, to be added with a ramp up, e.g., increase in pumping rate, and the remaining pumping units to ramp down, e.g., decrease in pumping rate. For example, the transition period 616 is 6 seconds in length, thus the balancing process can set the PUMP 5 rate change at 6 BPM per 6 seconds for an increase ramp rate of 1 BPM per second. The balancing process can set the rate change for the remaining three pumps to 2 BPM per 6 seconds for an decrease ramp rate of ⅓ BPM per sec. Thus, the balancing process can set the total combined ramp rate change of flowrate decreasing equal to the ramp rate change of flowrate increasing.

Figure 6C:
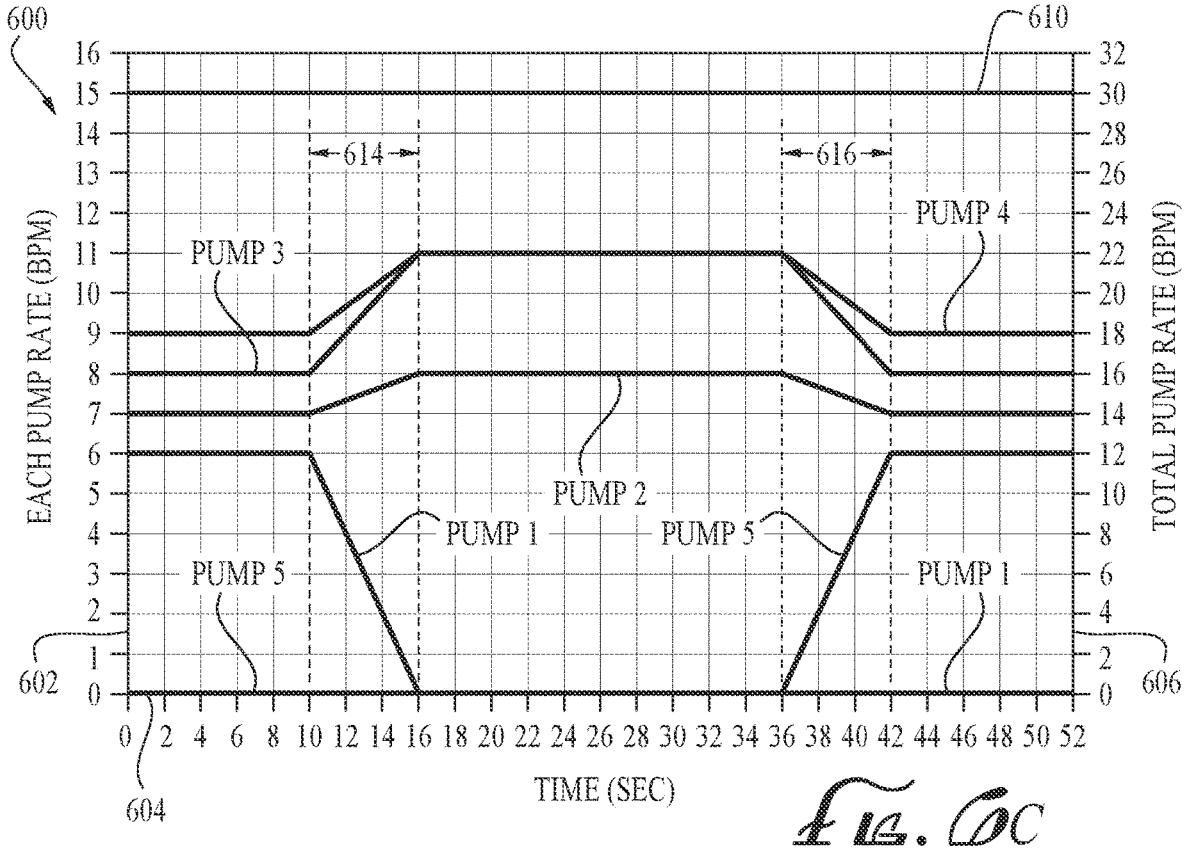

Turning now to a second example of FIG. 6C, the system controller within the control center 236 may receive an indication of reduced pumping performance, for example, an indication of an operational caution, e.g., overheating, or an indication that service is required, e.g., a reduction in pressure or rate, from PUMP 1 (pumping unit 220). The system controller can determine a new pumping rate for PUMP 2 (pumping unit 222), PUMP 3 (pumping unit 224), and PUMP 4 (pumping unit 226) based on the weighted factors of capacity, efficiency, service life, cost, or combinations thereof. The system controller may determine a first transition period 614 to reduce the pumping rate of PUMP 1 to zero while simultaneously compensating with the remaining pumping units so that the overall pumping rate does not change. The system controller may determine a second transition period 616 to increase the pumping rate of a new or replacement PUMP 5 while compensating with the remaining pumping units so that the overall pumping rate does not change.

The system controller may execute a balancing process 650 for flowrate balancing with the following steps. At step 652, the balancing process can determine the total flowrate of the system for the first balanced pump load. From the example of FIG. 6C, the total flowrate from line 610 is 30 BPM. At step 654, the balancing process can determine a total flowrate loss of the pumping system to be removed. From the example of FIG. 6C, Total Loss Flowrate can be 6 BPM for the removal of PUMP 1. At step 656, the balancing process can determine the remaining flowrate of the system. From FIG. 6C, the Remaining Flowrate can be 24 BPM. At step 658, the process can determine how to distribute the Total Loss Flowrate of 6 BPM to the remaining pumping units for the second balanced pump load.

The balancing process executing on the system controller can determine the new pumping rate target for each pump based on the weighted factors of capacity, efficiency, service life, and cost for the second balanced pump load. In the example of FIG. 6C, the balancing process may set PUMP 4 to a pumping rate target with an increase of 2 BPM due to the weighted factors. For example, PUMP 4 may have capacity and service life, but may be limited on efficiency and cost. The balancing process may set PUMP 3 to an increase of 3 BPM based on positive scores of capacity, service life, and efficiency but limited score for cost. The balancing process may set PUMP 2 to an increase of 1 BPM due to limited capacity.

The balancing process may determine a ramp rate for each of the pumps for a first transitional pump load during the transition period 614. For example, the transition period 614 is 6 seconds in length, thus the balancing process can set the PUMP 1 rate of change at 6 BPM per 6 seconds for a decrease in ramp rate of 1 BPM per second. The balancing process can set the rate change for the remaining three pumps based on the new pumping rate target. For example, the balancing process can set PUMP 4 to 2 BPM per 6 seconds for an increase ramp rate of ⅓ BPM per sec. The balancing process can set PUMP 3 to 3 BPM per 6 seconds for an increase ramp rate of ½ BPM per sec. The balancing process can set PUMP 2 to 1 BPM per 6 seconds for an increase ramp rate of ⅙ BPM per sec. Thus, the balancing process can set the ramp rate change of flowrate decreasing equal to the total combined ramp rate change of flowrate increasing.

The balancing process can simultaneously execute the new target flowrates for each of the pumps during the transition period 614 and prepare for the second transition period 616. In the example of FIG. 6C, PUMP 5 is idle, e.g., non-operating, during the initial pumping operation. The balancing process can determine a target flowrate for PUMP 5 based on the weighted factors. In the example provided, the balancing process can determine that PUMP 5 can replace the flowrate of PUMP 1 with a target rate of 6 BPM after the transition period 616. The balancing process can determine a balanced supplemental pump load based on the weighted factors that a new target rate for PUMP 4 is 9 BPM, a new target rate for PUMP 3 is 8 BPM, and a new target rate for PUMP 2 is 7 BPM.

In some embodiments, the balancing process can simultaneously execute the new target rates during the second transition period 616 with ramp up and ramp down rates. For example, the balancing process may determine a second transitional pump load with an increase ramp rate for the new pumping unit, PUMP 5, to be 6 BPM per 6 seconds for an increase in rate of 1 BPM per second. The balancing process can set the rate change for PUMP 4 to 2 BPM per 6 seconds for a decrease in rate of ⅓ BPM per sec. The balancing process can set PUMP 3 to 3 BPM per 6 seconds for an decrease of ½ BPM per sec. The balancing process can set PUMP 2 to 1 BPM per 6 sec for a decrease ramp rate of ⅙ BPM per sec. Thus, the balancing process can determine a second transitional pump load with the total combined ramp rate change for the flowrate decreasing equal to the ramp rate change of flowrate increasing.

Figure 6D:
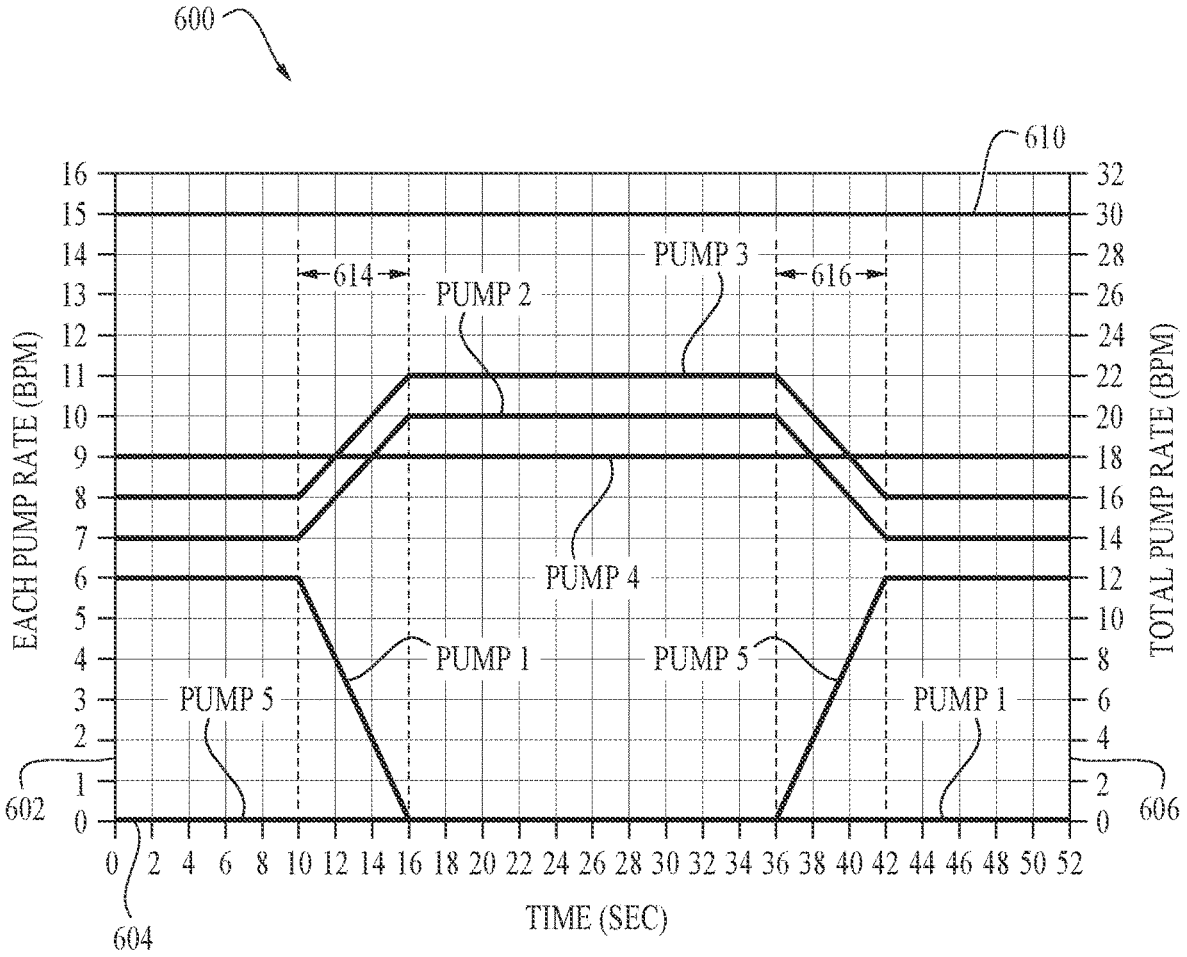

Turning now to a second example of FIG. 6D, the system controller within the control center 236 may receive an indication of reduced pumping performance, for example, an indication of an operational caution, e.g., overheating, or an indication that service is required, e.g., a reduction in pressure, from PUMP 1 (pumping unit 220). The system controller can determine a new pumping rate for PUMP 2 (pumping unit 222), PUMP 3 (pumping unit 224), and PUMP 4 (pumping unit 226) based on the weighted factors of capacity, efficiency, service life, cost, or combinations thereof. The system controller may determine a first transition period 614 to reduce the pumping rate of PUMP 1 to zero while simultaneously compensating with the remaining pumping units so that the overall pumping rate does not change. The system controller may determine a second transition period 616 to increase the pumping rate of a new or replacement PUMP 5 while compensating with the remaining pumping units so that the overall pumping rate does not change.

The system controller may simultaneously execute a balancing process for flowrate balancing with the following steps. At step 652, the balancing process can determine the total flowrate of the system. From the example of FIG. 6D, the total flowrate from line 610 is 30 BPM. At step 654, the balancing process can determine a total flowrate loss of the pumping system to be removed. From the example of FIG. 6D, the Total Loss Flowrate is 6 BPM for the removal of PUMP 1. At step 656, the balancing process can determine the remaining flowrate of the system. From FIG. 6D, the Remaining Flowrate is equal to 24 BPM. At step 658, the process can determine how to distribute the Total Loss Flowrate of 6 BPM to the remaining pumping units.

The balancing process executing on the system controller can determine the new pumping rate target for each pump based on the weighted factors of capacity, efficiency, service life, and cost. In the example of FIG. 6D, the balancing process may set PUMP 3 to a pumping rate target of 11 BPM with an increase of 3 BPM due to the weighted factors. For example, PUMP 3 may have a positive value for capacity, service life, efficiency and cost. The balancing process may set PUMP 2 to a pumping rate target of 10 BPM with an increase of 3 BPM due to the weighted factors. For example, PUMP 2 may have a positive value for capacity, service life, efficiency and cost. The balancing process may determine that PUMP 4 to stay at the current pumping rate target of 9 BPM based on neutral or limited scores for capacity, service life, and efficiency.

The balancing process may determine a ramp rate for each of the pumps during the transition period 614. For example, the transition period 614 is 6 seconds in length, thus the balancing process can set the PUMP 1 rate of change at a decrease ramp rate of 1 BPM per second. The balancing process can set the increase ramp rate change for PUMP 2 and PUMP 3 at ½ BPM per sec. The balancing process can set PUMP 4 to remain unchanged. Thus, the balancing process can set the ramp rate change of flowrate decreasing equal to the total combined rate change of flowrate increasing.

The balancing process can execute the new target flowrates for each of the pumps during the transition period 614 and prepare for the second transition period 616. In the example of FIG. 6D, PUMP 5 is idle, e.g., non-operating, during the initial pumping operation. The balancing process can determine a target flowrate for PUMP 5 based on the weighted factors. In the example provided, the balancing process can determine that PUMP 5 can replace the flowrate of PUMP 1 with a target rate of 6 BPM after the transition period 616. The balancing process can determine, based on the weighted factors, that a new target rate for PUMP 4 is 9 BPM, a new target rate for PUMP 3 is 8 BPM, and a new target rate for PUMP 2 is 7 BPM.

In some embodiments, the balancing process can simultaneously execute the new target rates during the second transition period 616 with ramp up and ramp down rates. For example, the balancing process may determine a ramp up rate for the new pumping unit, PUMP 5, to be an increase ramp rate of 1 BPM per second. The balancing process can set PUMP 2 and PUMP 3 to 3 BPM per 6 seconds for a decrease ramp rate of ½ BPM per sec. The balancing process can set PUMP 4 remain unchanged at 9 BPM. Thus, the balancing process can set the ramp rate change of total combined flowrate decreasing equal to the ramp rate change of flowrate increasing.

Figure 7:
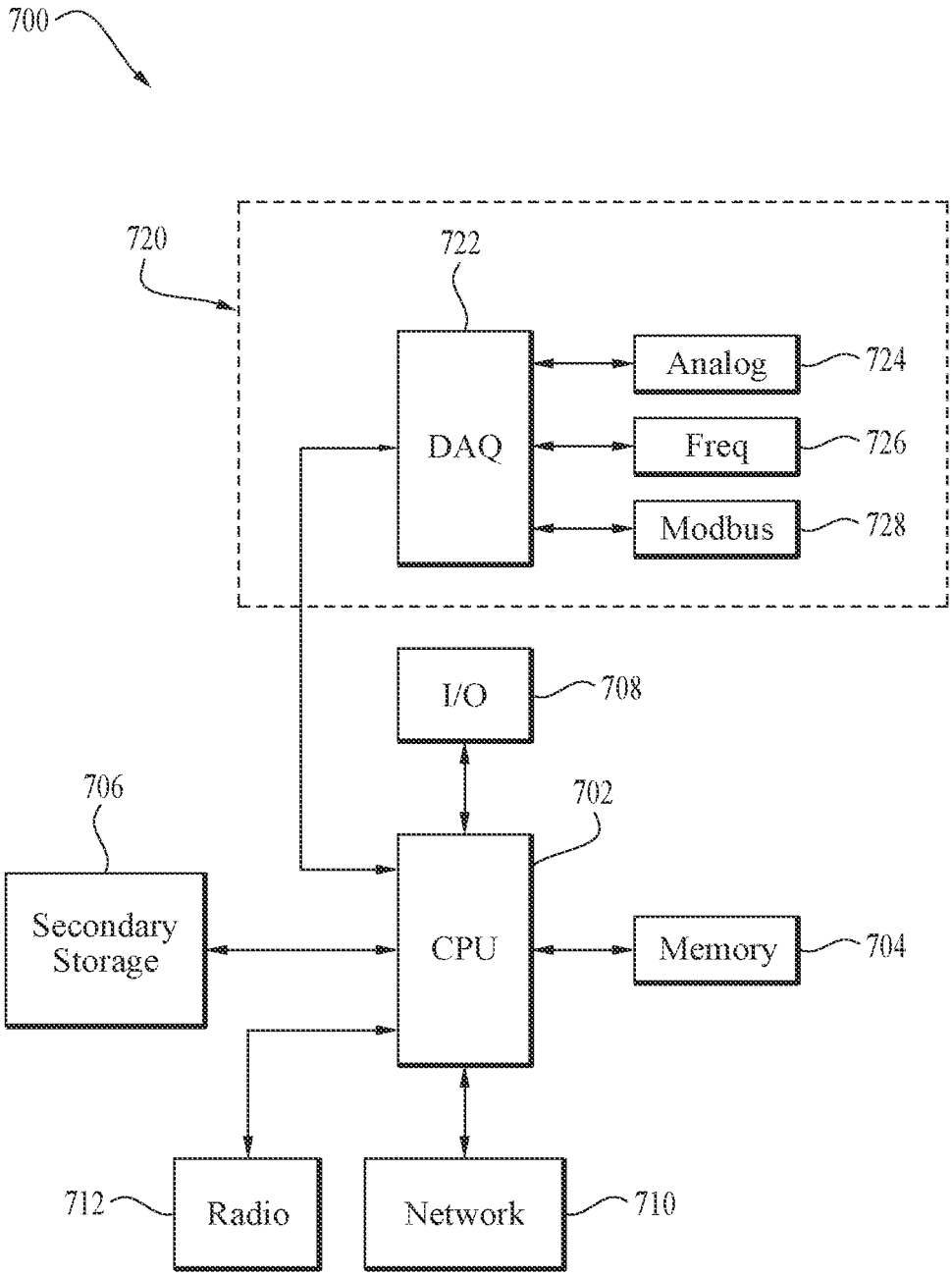
FIG. 7 is a block diagram of a computer system suitable for implementing one or more embodiments of the disclosure.

The computer system at the wellsite may be a computer system suitable for communication and control of the pumping equipment, e.g., a fracturing spread 200. The pumping operation described in FIG. 2 can be directed by a controller within the control center 236 that establishes control over each of the unit controllers, e.g., unit controller 140 of FIG. 1, and thus, establishes control of the pumping operations. A balancing process can be executing on the controller within the control center 236, a networked computer system, a remote computer system, or combinations thereof. In some embodiments, the controller within the control center 236, the unit controller 140 of FIG. 1, and unit controller 410 of FIG. 4 may be an exemplary computer system 700 described in FIG. 7. Turning now to FIG. 7, a computer system 700 suitable for implementing one or more embodiments of the unit controller, for example, unit controller 140, including without limitation any aspect of the computing system associated with the pumping operation of FIG. 2. The computer system 700 may be suitable for implementing one or more embodiments of a remote computer system, for example, a cloud computing system, a virtual network function (VNF) on a network slice of a cloud computing platform, and a plurality of user devices. The computer system 700 includes one or more processors 702 (which may be referred to as a central processor unit or CPU) that is in communication with memory 704, secondary storage 706, input output devices 708, and network devices 710. The computer system 700 may continuously monitor the state of the input devices and change the state of the output devices based on a plurality of programmed instructions. The programming instructions may comprise one or more applications retrieved from memory 704 for executing by the processor 702 in non-transitory memory within memory 704. The input output devices may comprise a Human Machine Interface with a display screen and the ability to receive conventional inputs from the service personnel such as push button, touch screen, keyboard, mouse, or any other such device or element that a service personnel may utilize to input a command to the computer system 700. The secondary storage 706 may comprise a solid state memory, a hard drive, or any other type of memory suitable for data storage. The secondary storage 706 may comprise removable memory storage devices such as solid state memory or removable memory media such as magnetic media and optical media, i.e., CD disks. The computer system 700 can communicate with various networks with the network devices 710 comprising wired networks, e.g., Ethernet or fiber optic communication, and short range wireless networks such as Wi-Fi (i.e., IEEE 802.11), Bluetooth, or other low power wireless signals such as ZigBee, Z-Wave, 6LoWPan, Thread, and WiFi-ah. The computer system 700 may include a long range radio transceiver 712 for communicating with mobile network providers.

In some embodiments, the computer system 700 may comprise a DAQ card 714 for communication with one or more sensors. The DAQ card 714 may be a standalone system with a microprocessor, memory, and one or more applications executing in memory. The DAQ card 714, as illustrated, may be a card or a device within the computer system 700. In some embodiments, the DAQ card 714 may be combined with the input output device 708. The DAQ card 714 may receive one or more analog inputs 716, one or more frequency inputs 718, and one or more Modbus inputs 920. For example, the analog input 716 may include a volume sensor, e.g., a tank level sensor. For example, the frequency input 718 may include a flow meter, i.e., a fluid system flowrate sensor. For example, the Modbus input 720 may include a pressure transducer. The DAQ card 714 may convert the signals received via the analog input 716, the frequency input 718, and the Modbus input 720 into the corresponding sensor data. For example, the DAQ card 714 may convert a frequency input 718 from the flowrate sensor into flowrate data measured in gallons per minute (GPM).

ADDITIONAL DISCLOSURE

The following are non-limiting, specific embodiments in accordance with the present disclosure:

A first embodiment, which is a computer-implemented method of balancing a pump load of a plurality of pumping units during a pumping operation, comprising determining, by a balancing process executing on a system controller, a first balanced pump load for the plurality of pumping units, and wherein the first balanced pump load includes a first pumping unit; determining, by the balancing process, a second balanced pump load, wherein a flowrate of treatment fluid for the second balanced pump load is equivalent to a flowrate of treatment fluid for the first balanced pump load, wherein the second balanced pump load comprises a revised plurality of pumping units that i) excludes the first pumping unit, ii) modifies the first pumping unit, or iii) replaces the first pumping unit with a second pumping unit; determining, by the balancing process, a third balanced pump load for a transition period, wherein the pump load for the first pumping unit is reduced to zero at an end of the transition period, wherein a ramp rate is determined for each pumping unit in the revised plurality of pumping units, wherein the ramp rate for each pumping unit in the revised plurality of pumping units is determined by the difference of the second balanced pump load and the first balanced pump load divided by a value of the transition period, wherein the ramp rate decreasing in value is equivalent to the ramp rate increasing in value, and wherein a flowrate of treatment fluid for the third balanced pump load is equivalent to the flowrate of treatment fluid for the first balanced pump load throughout the transition period; and controlling, by the balancing process, the revised plurality of pumping units to pump the wellbore treatment fluid in accordance with the second balanced pump load.

A second embodiment, which is the method of the first embodiment, further comprising receiving, by a balancing process, i) a prediction of reduced pumping performance of a first pumping unit or ii) an indication of reduced pumping performance of a first pumping unit.

A third embodiment, which is the method of the first or second embodiment, wherein the prediction of reduced pumping performance is based on service life remaining for the first pumping unit, or the indication of reduced pumping performance includes a measured reduction in pumping pressure for the first pumping unit, a measured reduction in pumping flowrate for the first pumping unit, or combinations thereof.

A fourth embodiment, which is the method of any of the first through the third embodiments, wherein an individual pump load for each individual pumping unit of the plurality of pumping units comprises an individual flowrate of treatment fluid for each individual pumping unit of the plurality of pumping units; and wherein the individual pump load for each individual pumping unit is determined based on at least one operational factor comprising capacity, capability, efficiency, service life, cost, or combinations thereof.

A fifth embodiment, which is the method of any of the first through the fourth embodiments, wherein the second balanced pump load transitions from the first balanced pump load in accordance with the third balanced pump load.

A sixth embodiment, which is the method of any of the first through the fifth embodiments, wherein the first pumping unit comprises a first pump and a second pump coupled to a prime mover.

A seventh embodiment, which is the method of any of the first through the sixth embodiments, wherein modifying the first pumping unit comprises i) decoupling the first pump from the prime mover or ii) decoupling the second pump from the prime mover.

An eighth embodiment, which is the method of any of the first through the seventh embodiments, further comprising ramping down, by the balancing process, a flowrate of the first pumping unit; and decoupling, by the balancing process, a first pump from a prime mover of the first pumping unit, wherein i) a prediction of reduced pumping performance was directed to the first pump or ii) an indication of reduced pumping performance was provided by the first pump to the balancing process.

A ninth embodiment, which is the method of any of the first through the eighth embodiments, further comprising transporting at least one blender, a fluid network, and the plurality of pumping units to a remote wellsite; fluidically coupling the plurality of pumping units to the at least one blender via the fluid network; fluidically coupling the plurality of pumping units to a wellbore via the fluid network; beginning a pumping operation by the system controller communicatively coupled to the plurality of pumping units; retrieving, by the system controller, periodic pumping data indicative of the pumping operation, and wherein the periodic pumping data includes an indication of pumping performance of each individual pumping unit of the plurality of pumping units; and pumping the wellbore treatment fluid into the wellbore via the fluid network.

A tenth embodiment, which is the method of any of the first through the ninth embodiments, wherein the indication of pumping performance of each individual pumping unit further comprises i) a prediction of reduced pumping performance of a first pumping unit or ii) an indication of reduced pumping performance of a first pumping unit.

An eleventh embodiment, which is a method of modifying one or more of a plurality of pumping units during a pumping operation delivering a wellbore treatment fluid into a wellbore penetrating a subterranean formation, comprising: determining, by a balancing process executing on a system controller, a first balanced pump load for a plurality of pumping units, wherein the plurality of pumping units comprises at least a first pumping unit, wherein the first balanced pump load comprises a flowrate of treatment fluid for the plurality of pumping units; wherein an individual pump load assigned to each individual pumping unit of the plurality of pumping units is determined by at least one operational factor; receiving, by the balancing process, an indicia of reduced pumping performance from a unit controller of the first pumping unit; determining, by the balancing process, a second balanced pump load, wherein the second balanced pump load comprises a flowrate of treatment fluid assigned to a reduced plurality of pumping units, wherein the reduced plurality of pumping units excludes the first pumping unit from the plurality of pumping units, and wherein the flowrate of treatment fluid for the second balanced pump load is equivalent to the flowrate of treatment fluid for the first balanced pump load; and wherein the individual pump load assigned to each individual pumping unit of the reduced plurality of pumping units is determined by the at least one operational factor.

A twelfth embodiment, which is the method of the eleventh embodiment, further comprising determining, by the balancing process, a transitional balanced pump load for a first transition period, wherein a ramp rate for each of the plurality of pumping units is determined by the difference of the second balanced pump load assigned to each of the reduced plurality of pumping units and the first balanced pump load assigned to each of the plurality of pumping units divided by the transition period, wherein the ramp rate for the first pumping unit results in a pumping rate of zero at an end of the transition period, wherein the ramp rate of a plurality of pumps decreasing in value is equivalent to the ramp rate of a plurality of pumps increasing in value, and wherein a flowrate of the wellbore treatment fluid for the transitional balanced pump load during the first transition period is equivalent to the flowrate of treatment fluid for the second balance pump load.

A thirteenth embodiment, which is the method of any of the eleventh and the twelfth embodiments, further comprising determining, by the balancing process, a supplemented balanced pump load for a supplemented plurality of pumping units, wherein the supplemented plurality of pumping units includes a second pumping unit that was held in reserve and excluded the first pumping unit, wherein the supplemented balanced pump load comprises a flowrate of treatment fluid assigned to the supplemented plurality of pumping units, wherein the flowrate of treatment fluid for the supplemented balanced pump load is equivalent to the flowrate of treatment fluid for the first balanced pump load, and wherein the individual pump load assigned to each individual pumping unit of the supplemented plurality of pumping units is determined by at least one operational factor.

A fourteenth embodiment, which is the method of any of the eleventh through the thirteenth embodiments, further comprising determining, by the balancing process, a second transitional balanced pump load for a second transition period, wherein a ramp rate for each of the plurality of pumping units is determined by the difference of the fourth balanced pump load assigned to each of the plurality of pumping units and the second balanced pump load assigned to each of the plurality of pumping units divided by the transition period, wherein the ramp rate for the second pumping unit begins with a pumping rate of zero at the beginning of the transition period, wherein the ramp rate of a plurality of pumps decreasing in value is equivalent to the ramp rate of a plurality of pumps increasing in value, and wherein a flowrate of the wellbore treatment fluid for the second transitional balanced pump load during the second transition period is equivalent to the flowrate of treatment fluid for the supplemented balanced pump load.

A fifteenth embodiment, which is the method of any of the eleventh through the fourteenth embodiments, wherein the at least one operational factor comprises a capacity value, a service life value, an efficiency value, a cost value, or combinations thereof, wherein the capacity value comprises an operational capacity of a pumping unit; wherein the service life value comprises a value of hours of pumping operation, a volume of fluid pumped, a type of fluid pumped, or combinations thereof, until required maintenance; wherein the efficiency value comprises a range of 60 percent to 90 percent efficiency; and wherein the cost value comprises a fuel cost and a maintenance cost.

A sixteenth embodiment, which is a system for pumping a wellbore treatment fluid into a wellbore penetrating a subterranean formation, comprising: a blender; a plurality of pumping units fluidically coupled to the blender and a wellbore; a system controller comprising a processor and a non-transitory memory communicatively coupled to the blender and the plurality of pumping units, configured to: pump, by the plurality of pumping units, a wellbore treatment fluid from the blender to the wellbore; balance, by a balancing process executing on the system controller, a first balanced pump load for the plurality of pumping units, wherein the first balanced pump load comprises a flowrate of treatment fluid for the plurality of pumping units; and replace a first pumping unit of the plurality of pumping units with a second pumping unit held in reserve.

An seventeenth embodiment, which is the system of the sixteenth embodiment, further comprising receive an indicia of a reduced pumping performance from a unit controller of the first pumping unit, wherein the indicia is a reduction in pumping pressure, pumping flowrate, user input, or combinations thereof.

An eighteenth embodiment, which is the system of the sixteenth and the seventeenth embodiment, wherein an individual pump load assigned to each individual pumping unit of the plurality of pumping units is determined by at least one operational factor.

A nineteenth embodiment, which is the system of any of the sixteenth through the eighteenth embodiments, further comprising determine, by the balancing process, a second balanced pump load, wherein the second balanced pump load excludes the first pumping unit and includes the second pumping unit, wherein the second balanced pump load comprises a flowrate of treatment fluid for the plurality of pumping units, wherein the second balanced pump load of the plurality of pumping units excluding the first pumping unit and including the second pumping unit is equivalent to the first balanced pump load of the plurality of pumping units that includes the first pumping unit, and wherein an individual pump load assigned to each individual pumping unit of the plurality of pumping units that excludes the first pumping unit and includes the second pumping unit is determined by at least one operational factor.

A twentieth embodiment, which is the system of any of the sixteenth through the nineteenth embodiments, further comprising transition, by the balancing process, from the first balanced pump load to the second balanced pump load during a transition period, wherein a ramp rate for each individual pumping unit is determined by the difference of the second pump load and the first pump load divided by the transition period, wherein the ramp rate for the first pumping unit results in a pumping rate of zero at an end of the transition period, wherein the ramp rate of the second pumping unit begins with a pumping rate of zero at a beginning of the transition period, and wherein the pump load during the transition period is equivalent to the second pump load.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A method of balancing a pump load of a plurality of pumping units during a pumping operation delivering a wellbore treatment fluid into a wellbore penetrating a subterranean formation, comprising:

determining, by a balancing process executing on a system controller, a first balanced pump load defining a flow rate of the treatment fluid for the plurality of pumping units, and wherein the first balanced pump load includes a first pumping unit;

determining, by the balancing process, a second balanced pump load, wherein a flowrate of treatment fluid for the second balanced pump load is equivalent to the flowrate of treatment fluid for the first balanced pump load, wherein the second balanced pump load comprises a revised plurality of pumping units that i) excludes the first pumping unit, ii) modifies the first pumping unit, or iii) replaces the first pumping unit with a second pumping unit;

determining, by the balancing process, a third balanced pump load for a transition period, wherein the pump load for the first pumping unit is reduced to zero at an end of the transition period, wherein a ramp rate is determined for each pumping unit in the revised plurality of pumping units, wherein the ramp rate for each pumping unit in the revised plurality of pumping units is determined by the difference of the second balanced pump load and the first balanced pump load divided by a value of the transition period, wherein the ramp rate decreasing in value is equivalent to the ramp rate increasing in value, and wherein a flowrate of treatment fluid for the third balanced pump load is equivalent to the flowrate of treatment fluid for the first balanced pump load throughout the transition period; and controlling, by the balancing process, the revised plurality of pumping units to pump the wellbore treatment fluid in accordance with the second balanced pump load.

2. The method of claim 1, further comprising:

receiving, by a balancing process, i) a prediction of reduced pumping performance of a first pumping unit or ii) an indication of reduced pumping performance of a first pumping unit.

3. The method of claim 2, wherein:

the prediction of reduced pumping performance is based on service life remaining for the first pumping unit, or the indication of reduced pumping performance includes a measured reduction in pumping pressure for the first pumping unit, a measured reduction in pumping flowrate for the first pumping unit, or combinations thereof.

4. The method of claim 1, wherein:

an individual pump load for each individual pumping unit of the plurality of pumping units comprises an individual flowrate of treatment fluid for each individual pumping unit of the plurality of pumping units; and wherein the individual pump load for each individual pumping unit is determined based on at least one operational factor comprising capacity, capability, efficiency, service life, cost, or combinations thereof.

5. The method of claim 1, wherein the second balanced pump load transitions from the first balanced pump load in accordance with the third balanced pump load.

6. The method of claim 1, wherein the first pumping unit comprises a first pump and a second pump coupled to a prime mover.

7. The method of claim 6, wherein modifying the first pumping unit comprises i) decoupling the first pump from the prime mover or ii) decoupling the second pump from the prime mover.

8. The method of claim 1, further comprising:

ramping down, by the balancing process, a flowrate of the first pumping unit; and decoupling, by the balancing process, a first pump from a prime mover of the first pumping unit, wherein i) a prediction of reduced pumping performance was directed to the first pump or ii) an indication of reduced pumping performance was provided by the first pump to the balancing process.

9. The method of claim 1, further comprising:

transporting at least one blender, a fluid network, and the plurality of pumping units to a remote wellsite;

fluidically coupling the plurality of pumping units to the at least one blender via the fluid network;

fluidically coupling the plurality of pumping units to a wellbore via the fluid network;

beginning a pumping operation by the system controller communicatively coupled to the plurality of pumping units;

retrieving, by the system controller, periodic pumping data indicative of the pumping operation, and wherein the periodic pumping data includes an indication of pumping performance of each individual pumping unit of the plurality of pumping units; and pumping the wellbore treatment fluid into the wellbore via the fluid network.

10. The method of claim 9, wherein the indication of pumping performance of each individual pumping unit further comprises i) a prediction of reduced pumping performance of a first pumping unit or ii) an indication of reduced pumping performance of a first pumping unit.

11. A method of modifying one or more of a plurality of pumping units during a pumping operation delivering a wellbore treatment fluid into a wellbore penetrating a subterranean formation, comprising:

determining, by a balancing process executing on a system controller, a first balanced pump load for a plurality of pumping units, wherein the plurality of pumping units comprises at least a first pumping unit, wherein the first balanced pump load comprises a first flowrate of treatment fluid for the plurality of pumping units;

wherein an individual pump load assigned to each individual pumping unit of the plurality of pumping units is determined by at least one operational factor;

receiving, by the balancing process, an indicia of reduced pumping performance from a unit controller of the first pumping unit;

determining, by the balancing process, a second balanced pump load, wherein the second balanced pump load comprises a second flowrate of treatment fluid assigned to a reduced plurality of pumping units, wherein the reduced plurality of pumping units excludes the first pumping unit from the plurality of pumping units, and wherein the second flowrate of treatment fluid for the second balanced pump load is equivalent to the first flowrate of treatment fluid for the first balanced pump load; and wherein the individual pump load assigned to each individual pumping unit of the reduced plurality of pumping units is determined by the at least one operational factor.

12. The method of claim 11, further comprising:

determining, by the balancing process, a transitional balanced pump load for a first transition period, wherein a ramp rate for each of the plurality of pumping units is determined by the difference of the second balanced pump load assigned to each of the reduced plurality of pumping units and the first balanced pump load assigned to each of the plurality of pumping units divided by the transition period, wherein the ramp rate for the first pumping unit results in a pumping rate of zero at an end of the transition period, wherein the ramp rate of a plurality of pumps decreasing in value is equivalent to the ramp rate of a plurality of pumps increasing in value, and wherein a flowrate of the wellbore treatment fluid for the transitional balanced pump load during the first transition period is equivalent to the second flowrate of treatment fluid for the second balance pump load.

13. The method of claim 11, further comprising:

determining, by the balancing process, a supplemented balanced pump load for a supplemented plurality of pumping units, wherein the supplemented plurality of pumping units includes a second pumping unit that was held in reserve and excluded the first pumping unit, wherein the supplemented balanced pump load comprises a flowrate of treatment fluid assigned to the supplemented plurality of pumping units, wherein the flowrate of treatment fluid for the supplemented balanced pump load is equivalent to the first flowrate of treatment fluid for the first balanced pump load, and wherein the individual pump load assigned to each individual pumping unit of the supplemented plurality of pumping units is determined by at least one operational factor.

14. The method of claim 13, further comprising:

determining, by the balancing process, a second transitional balanced pump load for a second transition period, wherein a ramp rate for each of the plurality of pumping units is determined by the difference of the fourth balanced pump load assigned to each of the plurality of pumping units and the second balanced pump load assigned to each of the plurality of pumping units divided by the transition period, wherein the ramp rate for the second pumping unit begins with a pumping rate of zero at the beginning of the transition period, wherein the ramp rate of a plurality of pumps decreasing in value is equivalent to the ramp rate of a plurality of pumps increasing in value, and wherein a flowrate of the wellbore treatment fluid for the second transitional balanced pump load during the second transition period is equivalent to the flowrate of treatment fluid for the supplemented balanced pump load.

15. The method of claim 11, wherein:

the at least one operational factor comprises a capacity value, a service life value, an efficiency value, a cost value, or combinations thereof;

wherein the capacity value comprises an operational capacity of a pumping unit;

wherein the service life value comprises a value of hours of pumping operation, a volume of fluid pumped, a type of fluid pumped, or combinations thereof, until required maintenance;

wherein the efficiency value comprises a range of 60 percent to 90 percent efficiency; and wherein the cost value comprises a fuel cost and a maintenance cost.

16. A system for pumping a wellbore treatment fluid into a wellbore penetrating a subterranean formation, comprising:

a blender;

a plurality of pumping units fluidically coupled to the blender and a wellbore;

a system controller comprising a processor and a non-transitory memory communicatively coupled to the blender and the plurality of pumping units, configured to:

pump, by the plurality of pumping units, a wellbore treatment fluid from the blender to the wellbore;

balance, by a balancing process executing on the system controller, a first balanced pump load for the plurality of pumping units, wherein the first balanced pump load comprises a flowrate of treatment fluid for the plurality of pumping units; replace a first pumping unit of the plurality of pumping units with a second pumping unit held in reserve; and determine, by the balancing process, a second balanced pump load, wherein the second balanced pump load excludes the first pumping unit and includes the second pumping unit, wherein the second balanced pump load comprises a flowrate of treatment fluid for the plurality of pumping units, wherein the second balanced pump load of the plurality of pumping units excluding the first pumping unit and including the second pumping unit is equivalent to the first balanced pump load of the plurality of pumping units that includes the first pumping unit, and wherein an individual pump load assigned to each individual pumping unit of the plurality of pumping units that excludes the first pumping unit and includes the second pumping unit is determined by at least one operational factor.

17. The system of claim 16, further comprising:

receive an indicia of a reduced pumping performance from a unit controller of the first pumping unit, wherein the indicia is a reduction in pumping pressure, pumping flowrate, user input, or combinations thereof.

18. The system of claim 16, wherein:

an individual pump load assigned to each individual pumping unit of the plurality of pumping units is determined by at least one operational factor.

19. The system of claim 16, wherein the system controller is further configured to:

transition, by the balancing process, from the first balanced pump load to the second balanced pump load during a transition period, wherein a ramp rate for each individual pumping unit is determined by the difference of the second pump load and the first pump load divided by the transition period, wherein the ramp rate for the first pumping unit results in a pumping rate of zero at an end of the transition period, wherein the ramp rate of the second pumping unit begins with a pumping rate of zero at a beginning of the transition period, and wherein the pump load during the transition period is equivalent to the second pump load.

20. The method of claim 1, wherein the treatment fluid comprises a fracturing fluid.

* * * * *